US008616159B1

(12) United States Patent
Hawkins

(10) Patent No.: US 8,616,159 B1
(45) **Date of Patent: *Dec. 31, 2013**

(54) WHEELED, MANUALLY MOVEABLE, PROPANE FUELED ELECTRIC GENERATOR

(76) Inventor: Bobby L. Hawkins, Travelers Rest, SC (US)

( * ) Notice: Subject to any disclaimer, the term of this patent is extended or adjusted under 35 U.S.C. 154(b) by 751 days.

This patent is subject to a terminal disclaimer.

(21) Appl. No.: 12/817,688

(22) Filed: Jun. 17, 2010

Related U.S. Application Data

(63) Continuation-in-part of application No. 12/684,249, filed on Jan. 8, 2010.

(60) Provisional application No. 61/218,292, filed on Jun. 18, 2009, provisional application No. 61/231,816, filed on Aug. 6, 2009.

(51) Int. Cl.
*F02B 63/00* (2006.01)

(52) U.S. Cl.
USPC ..... 123/2; 123/3

(58) Field of Classification Search
USPC ..... 123/2, 3, 198 E; 248/27.3, 49
See application file for complete search history.

(56) References Cited

U.S. PATENT DOCUMENTS 2,789,756 A * 4/1957 Allen ..... 137/899.4
2,812,041 A * 11/1957 Mugler ..... 188/74
3,964,458 A * 6/1976 Strauss et al. ..... 123/552
RE28,936 E * 8/1976 Talamantez ..... 280/5.2
4,534,118 A * 8/1985 Cabus et al. ..... 34/514
5,924,393 A * 7/1999 Kikuchi ..... 123/2
6,139,029 A * 10/2000 Shaw ..... 280/8
6,313,543 B1 * 11/2001 Frank ..... 290/1 A
6,352,792 B1 3/2002 Parchamazad
6,441,505 B1 8/2002 Poletti et al.
6,534,958 B1 * 3/2003 Graber et al. ..... 322/11
6,653,005 B1 11/2003 Muradov
6,750,556 B2 * 6/2004 Sodemann et al. ..... 290/1 A
6,758,169 B2 * 7/2004 Suzuki et al. ..... 123/3
6,923,475 B1 * 8/2005 Martin et al. ..... 280/789
7,089,889 B2 * 8/2006 Johnson et al. ..... 123/2
7,245,032 B2 7/2007 Willets et al.
7,475,888 B2 * 1/2009 Craig et al. ..... 280/47.18
7,490,847 B2 * 2/2009 Dahl ..... 280/638
D595,227 S * 6/2009 Hawkins ..... D13/116
D597,944 S * 8/2009 Takamura ..... D13/116

(Continued)

OTHER PUBLICATIONS

Battery Reference Book by Thomas P J Crompton, May 25, 2000, p. 47/14.*

*Primary Examiner* — Thanh Truong
*Assistant Examiner* — Omar Morales
(74) *Attorney, Agent, or Firm* — Dority & Manning, P.A.

(57) ABSTRACT

A wheeled, manually movable, internal combustion engine powered electric generator mounts in a rigid frame formed of tubular steel elements. A pair of aligned wheels is pivotally mounted to each opposite side of the frame. One pair of aligned wheels is provided with a locking mechanism that enables both the front and rear wheels to be locked against rotation. The electricity generating components mount to the bottom of the frame. The internal combustion engine mounts toward the rear end of the frame. A propane fuel tank is carried above the engine by the upper rear portion of the frame. A battery and a trickle charger are carried above the engine and secured in a compartment with a locked hinged cover. The frame also supports and contains a locked compartment that houses the electric connector that is used to connect the electric output of the generator to the load.

21 Claims, 12 Drawing Sheets

(56) References Cited

U.S. PATENT DOCUMENTS

| | | | | |
|---|---|---|---|---|
| 7,673,589 | B2 * | 3/2010 | Shimada et al. | 123/2 |
| 8,134,244 | B2 * | 3/2012 | Wurth | 290/1 A |
| 2004/0168654 | A1 * | 9/2004 | Radtke | 123/2 |
| 2006/0066108 | A1 | 3/2006 | Willets et al. | |
| 2006/0214425 | A1 * | 9/2006 | Yamamoto et al. | 290/1 A |
| 2008/0111013 | A1 * | 5/2008 | Suckle et al. | 242/370 |
| 2008/0202447 | A1 * | 8/2008 | Kochi et al. | 123/2 |
| 2009/0284022 | A1 * | 11/2009 | Usselman et al. | 290/38 R |

* cited by examiner

WHEELED, MANUALLY MOVEABLE, PROPANE FUELED ELECTRIC GENERATOR

CROSS-REFERENCE TO RELATED APPLICATIONS

This application claims benefit to the following U.S. provisional patent application Ser. No. 61/218,292 filed Jun. 18, 2009; and Ser. No. 61/231,816 filed Aug. 6, 2009 and claims benefit to and is a continuation-in-part application to U.S. regular patent application Ser. No. 12/684,249 filed Jan. 8, 2010. Each of the foregoing applications being hereby incorporated herein for all purposes by this reference.

STATEMENT REGARDING FEDERALLY SPONSORED RESEARCH OR DEVELOPMENT

N/A

BACKGROUND OF THE INVENTION

This application pertains to electric generators that have wheels by which they can be moved manually and that are powered by an internal combustion engine that uses propane fuel.

Electric generators having an internal combustion engine that is fueled by propane dispensed from a tank that is housed in the same cabinet that also houses the internal combustion engine are known, and an example is disclosed in U.S. Pat. No. 6,441,505, which by this reference is hereby incorporated herein for all purposes. However, this generator is not mobile, and its cabinet is configured to rest on a flat surface and carries the tank containing the propane fuel beneath the internal combustion engine. A power system that has a mobile generator and reciprocating engine that can be fueled by propane supplied from storage tanks is disclosed in U.S. Pat. No. 7,245,032, which by this reference is hereby incorporated herein for all purposes. However, the storage tanks that supply back-up propane fuel for the engine are not mobile.

OBJECTS AND SUMMARY OF THE INVENTION

It is a principal object of the present invention to provide a wheeled, manually movable, internal combustion engine powered electric generator that can operate continuously fueled by its own portable reservoir of propane fuel and yet be capable of being moved off-road to negotiate across relatively rough terrain by one or two men on foot.

It also is a principal object of the present invention to provide a wheeled, manually movable, internal combustion engine powered electric generator that quickly and easily can be partially disassembled for ease of shipment and storage and re-assembled once arriving on site for operation.

It is a further principal object of the present invention to provide a wheeled, manually movable, internal combustion engine powered electric generator that can operate continuously fueled by its own portable reservoir of propane fuel and provide the mixing regulator valve relatively secure against unwanted tampering or damage.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out throughout this patent application.

To achieve the objects and in accordance with the purpose of the invention, as embodied and broadly described herein, a wheeled, manually movable, electric generator that is powered by an internal combustion engine that uses propane fuel is mounted in a rigid frame formed of tubular steel elements. The frame defines a front end, which is disposed in the axial direction opposite the rear end. The transverse dimension of the frame 20 is measured in a direction that is orthogonal (perpendicular) to the axial direction. The frame further defines a first side and a second side spaced apart in the transverse direction from the first side. Either of the front end and the rear end can be considered to be either of the first end and the second end or vice versa. Similarly, either of the first side and the second side can be considered to be either of the left side and the right side.

The electricity generating components, i.e., the internal combustion engine and the electric stator and rotor, which are the heaviest components, desirably are mounted to the bottom of the frame. The internal combustion engine desirably is mounted toward the front end of the frame, and the electric stator and rotor desirably are mounted toward the rear end of the frame.

The upper rear portion of the frame houses a propane fuel tank that desirably holds more than 9 gallons of propane fuel. The fuel tank for storing the propane fuel desirably is mounted detachably in a cradle that is carried by the frame on a platform disposed above the electric stator and rotor and toward the rear end of the frame. The propane fuel tank is desirably oriented so that the central axis of cylindrical symmetry of the tank is pointed in the transverse direction of the frame. The propane fuel tank desirably is held in place on the cradle by at least two pairs of securement straps. One end of each strap is anchored to the frame, and each pair of straps desirably has an adjustable buckle on at least the free end of one of the straps in the pair. In this way, propane fuel tanks of different circumferences can be secured to the cradle. The disengagement of each of the adjustable buckles loosens the securement straps and permits the user selectively to remove the propane fuel tank from the frame. A retention rod desirably is carried by the frame and disposed to engage the propane fuel tank and restrain the propane fuel tank from shifting from one side of the frame toward the opposite side of the frame when the propane fuel tank is carried by the frame.

Each of the uppermost surfaces of the upper crossbraces of the generator's frame desirably carries a pair of stacking disks that enable one generator to be stacked on top of another generator during shipping. Moreover, since the propane fuel tank is desirably oriented so that the central axis of cylindrical symmetry of the tank is pointed in the transverse direction of the frame, removal of the propane fuel tank from the cradle is not required to allow one generator unit to be stacked atop another generator unit for efficient use of space during shipping of multiple units.

The upper front section of the frame desirably supports and contains a regulator compartment that houses the mixing valve for the dispensing of the propane fuel to the internal combustion engine, which except for a different carburetor is essentially a gasoline engine. A hinged cover desirably encloses the regulator compartment, and a lock desirably is provided to secure the cover in the closed position.

The regulator compartment desirably houses the electrical connector and associated power cord that are used to connect the electric output of the generator to the load, which typically will be the electric service to a home or an isolated vacation cabin. The front wall portion of the regulator compartment desirably is configured to permit the cover to be closed and locked while the connector is disposed outside the compartment and connected to the load.

The upper front section of the frame also houses a battery compartment in which the direct current battery for the internal combustion engine is housed together with a trickle charger that is electrically connected to the battery. The battery compartment also desirably is provided with a hinged cover that desirably is provided with a locking mechanism. The control panel for the electrical connector desirably is housed beneath the propane fuel tank on one side of the frame. Hinged and lock-bearing side panels desirably provide doors that selectively govern access to the run/stop switch of the generator and to the control panel for the electrical connector. The interior surfaces of the side panels also desirably can be provided with sound insulating material. Desirably, a single key operates all of the locking mechanisms provided on the generator.

A hand guard panel desirably is attached to the front right vertical leg of the frame near the internal combustion engine and desirably is provided with a plurality of openings that facilitate air circulation but are not so large that a person could put one's hands through the openings and be harmed by operation of the engine.

A pair of aligned wheels is provided in a wheel assembly, and one wheel assembly is pivotally mounted to each opposite side of the frame such that the pivot point will be disposed between the front end of the frame and the center of gravity of the overall unit, both with an empty propane fuel tank and with a full tank of propane fuel. Each wheel assembly desirably includes a wheel support, and a lifting pivot pin desirably can be provided on each of the left and right wheel supports to facilitate lifting the rear set of wheels in order to negotiate elevated obstacles and to facilitate pivoting the generator to its left and to its right on the front set of wheels. A quick-disconnect member desirably is selectively connected to each wheel assembly and configured to selectively permit quickly disconnecting that respective wheel assembly from its respective side of the frame.

At least one pair of aligned wheels desirably can be provided with a locking mechanism that enables both the front and rear wheels to be locked against rotation once the unit is situated where desired. The wheel locks desirably can be disposed on only one pair of aligned wheels so that if disposed on an incline, the side of generator without the locked wheels will tend to arc in a circle rather than follow the pull of gravity down the incline.

A retractable handle desirably is mounted to the upper portion of the front end of the frame to facilitate lifting of the unit when necessary to negotiate past obstacles that cannot be negotiated with the unit being pushed or pulled on the wheel set. A locking front panel desirably is provided to enable the user to selectively lock the front handle in the fully extended horizontal position. The interior surface of the locking front panel desirably can be provided with sound insulation, which deadens the noise of the generator when the handle and front panel are retracted to their positions against the front of the generator. A retractable, twin grip handle desirably is mounted to the upper portion of the rear end of the frame. The twin grip handle also desirably can be locked in the upright horizontal position so that when the user stops gripping the handles, they remain in the upright horizontal position. The interior surface of a rear panel also desirably can be provided with sound insulating material.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

DETAILED DESCRIPTION OF THE PREFERRED EMBODIMENTS

Reference now will be made in detail to the presently preferred embodiments of the invention, several examples of which being illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of what could be claimed and equivalents thereof. The same numerals are assigned to the same components throughout the drawings and description.

Figure 1:
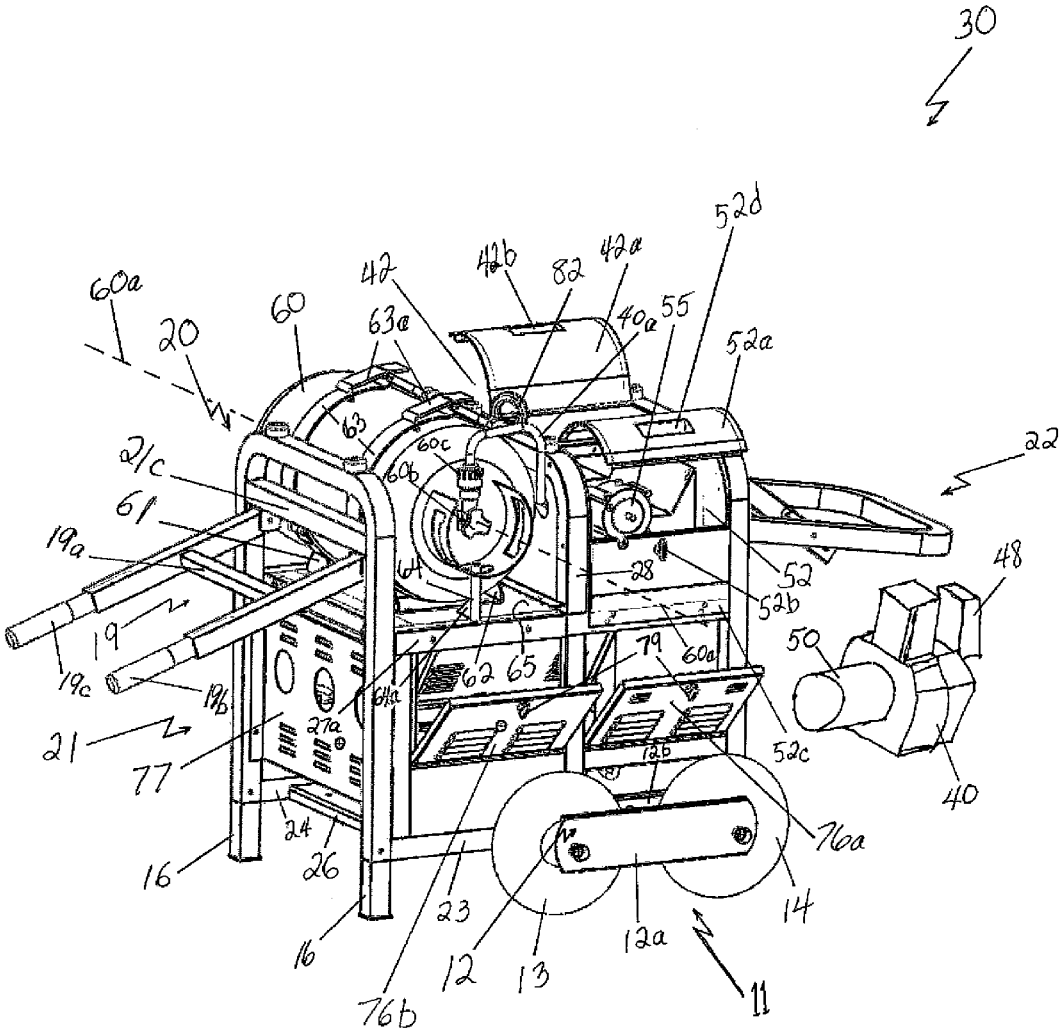
FIG. 1 is an elevated perspective view of the rear and right side of assembled components of a partially assembled, preferred embodiment of the wheeled, manually movable, internal combustion engine powered electric generator of the present invention.

One of the presently preferred embodiments of the wheeled, manually movable, internal combustion engine powered electric generator is shown in FIG. 1 and is represented generally by the numeral 30. The wheeled, manually movable, internal combustion engine powered electric generator includes a rigid frame generally designated by the numeral 20, and the frame 20 is desirably formed of sixteen gauge tubular steel elements. As shown in FIG. 1, the frame 20 defines an axial direction from a rear end 21 to a front end 22, which is disposed opposite the rear end 21. The frame 20 further defines a transverse direction orthogonal to the axial direction. The frame further defines a first side and a second side spaced apart in the transverse direction from the first side. Either of the front end 22 and the rear end 21 can be considered to be either of the first end and the second end or vice versa. Similarly, either of the first side and the second side can be considered to be either of the left side and the right side. For example, viewed in FIG. 1 from the perspective of the generator (as opposed to the perspective of the viewer looking at the generator), the first side can be considered to be the right side of the generator 30, and the second side can be considered to be the left side of the generator 30. In the views shown in the Figures, some of the components of the wheeled, manually movable, internal combustion engine powered electric generator 30 are shown pulled away from the frame 20 or in isolation or absent altogether in order to permit more informative illustration of other components.

Figure 3:
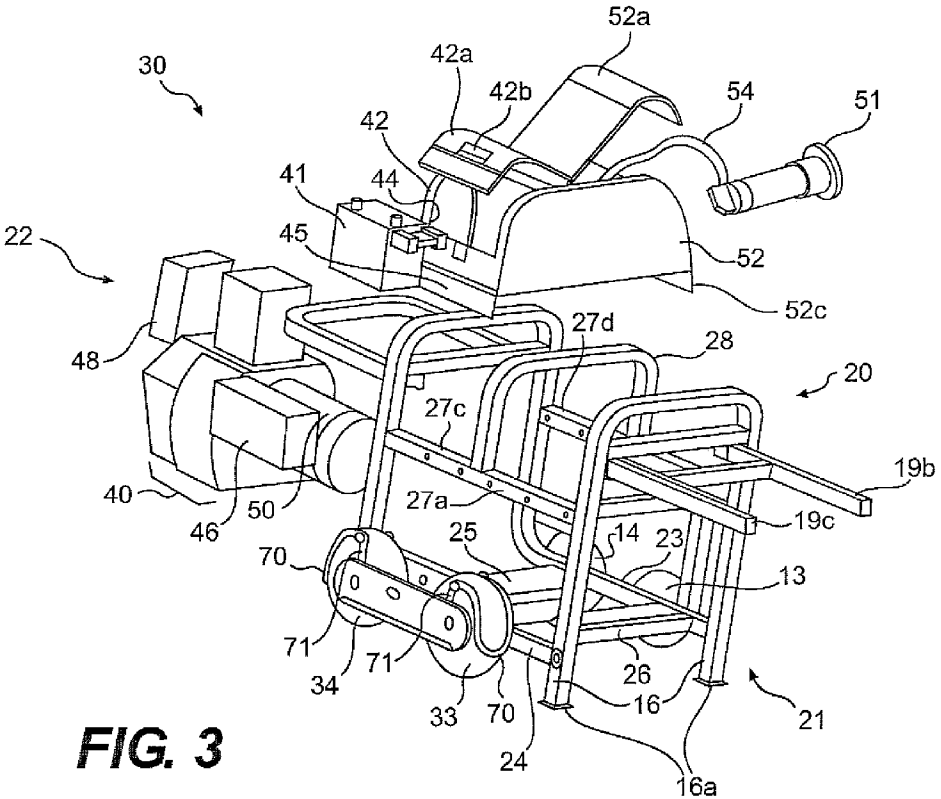
FIG. 3 is an elevated perspective view of the rear and left side of assembled components of a partially assembled, embodiment of the wheeled, manually movable, internal combustion engine powered electric generator of the present invention.

As schematically shown in FIG. 1 for example, in addition to the frame 20, the wheeled, manually movable, internal combustion engine powered electric generator 30 comprises an internal combustion engine 40 and an electric generator, which is not visible due to the surrounding housing 50. The electric generator desirably is carried by the frame 20 and connected to the engine 40. As shown schematically in FIG. 1, the electric generator within the housing 50 is connected mechanically to be driven by the engine 40. As is conventional, the electric generator desirably can include a stator and a rotor that is rotatably disposed with respect to the stator and connected to be rotatably driven by an output shaft of the internal combustion engine, the details of which arrangement being conventional and thus not depicted in the drawings. As shown in FIGS. 1 and 3 for example, the internal combustion engine 40 desirably can be provided with an air filter 48.

Figure 2:
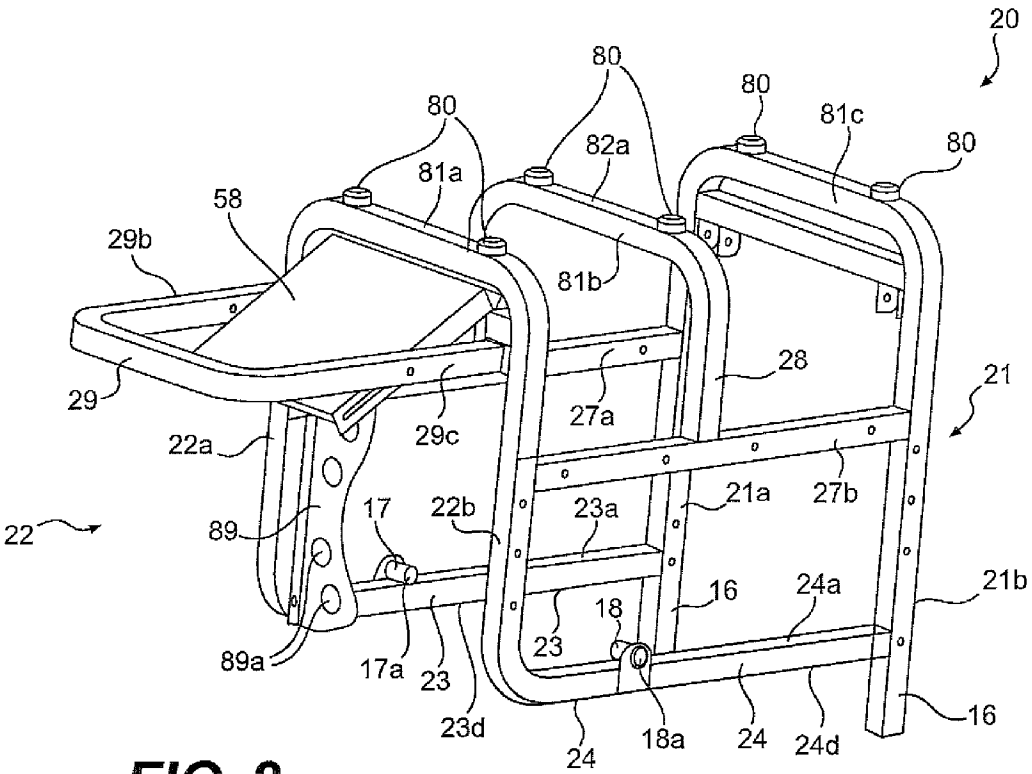
FIG. 2 is an elevated perspective view of from the left front of a frame component of a presently preferred embodiment of the wheeled, manually movable, internal combustion engine powered electric generator of the present invention.
Figure 6:
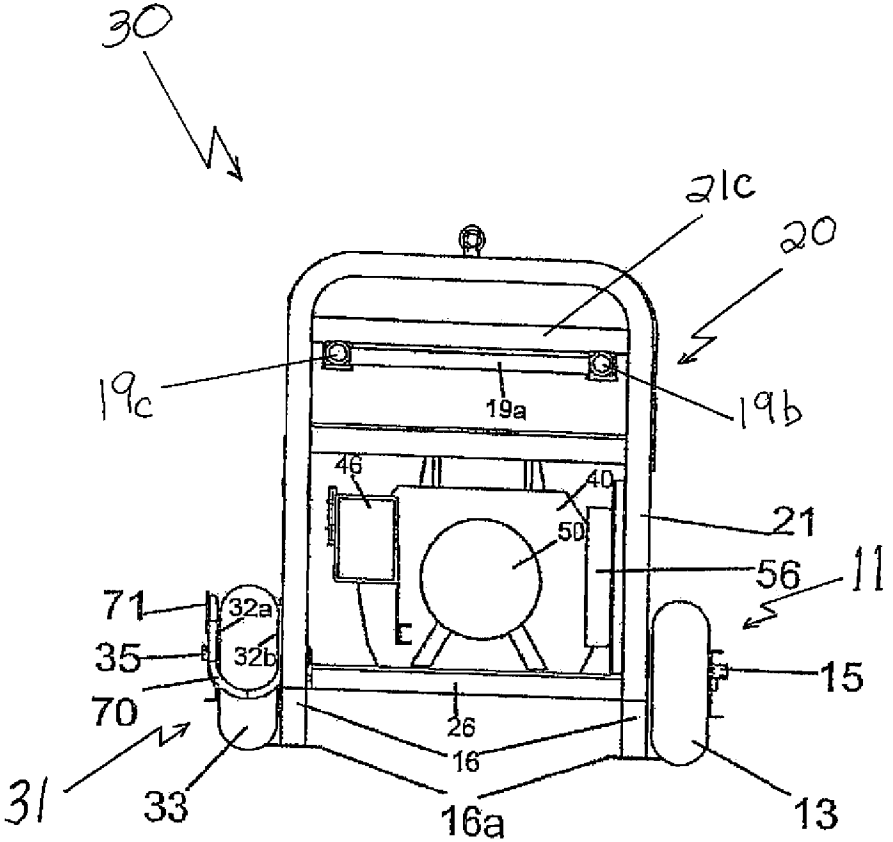
FIG. 6 is a rear, head-on view of assembled components of a partially assembled, preferred embodiment of the wheeled, manually movable, internal combustion engine powered electric generator of the present invention.

As shown in FIG. 2, the frame 20 desirably is divided into an upper portion and a lower portion. The lower portion of the frame includes the bottom of the frame, which can include a right bottom rail 23 and a left bottom rail 24. As shown in FIG. 3, one side end of a front bottom panel 25 can be connected in a conventional manner (welded or mechanical fasteners) to the right bottom rail 23, and the opposite side end of the front bottom panel 25 can be connected to the left bottom rail 24. One side end of a rear bottom panel 26 can be connected to the right bottom rail 23, and the opposite side end of the rear bottom panel 26 can be connected to the left bottom rail 24. The internal combustion engine 40 desirably is mounted toward the front end 22 of the frame 20, and the electric stator and rotor desirably are mounted toward the rear end 21 of the frame 20. When assembled as shown in FIG. 6 for example, the housing 50 for the electric stator and electric rotor is mounted toward the rear end 21 of the frame 20 and is carried by and connected to the rear bottom panel 26. The internal combustion engine 40 is mounted toward the front end 22 of the frame 20 and is carried by and connected to the front bottom panel 25 (e.g., FIG. 4). Thus, the internal combustion engine 40 and the electric stator and rotor, which are the heaviest components, are carried by the bottom of the frame 20.

As shown in FIG. 2 for example, the upper portion of the frame 20 desirably includes at least one upper crossbrace 81*a* extending transversely between the frame's first side and second side. The frame 20 desirably includes two additional upper crossbraces 81*b*, 81*c* that desirably are disposed parallel to the first upper crossbrace 81*a* and spaced apart therefrom and from each other. The uppermost surfaces of the upper crossbraces 81*a*, 81*b*, 81*c* of the frame define the uppermost surfaces of the frame 20.

As shown in FIG. 2, the frame desirably can include a right front upright member 22*a* having a lower end connected to or unitary with the front end of the right bottom rail 23. The right front upright member 22*a* has an upper end connected to or unitary with a right end of the forwardmost upper crossbrace 81*a*. Similarly, the frame desirably can include a left front upright member 22*b* that has a lower end connected to or unitary with the front end of the left bottom rail 24. The left front upright member 22*b* has an upper end connected to or unitary with a left end of the forwardmost upper crossbrace 81*a*.

As shown in FIG. 2, the frame desirably can include a right rear upright member 21*a* having a lower end connected to or unitary with a right rear support leg 16 and the rear end of the right bottom rail 23. The right rear upright member 21*a* has an upper end connected to or unitary with a right end of the rearwardmost upper crossbrace 81*c*. Similarly, the frame desirably can include a left rear upright member 21*b* that has a lower end connected to or unitary with a left rear support leg 16 and the rear end of the left bottom rail 24. The left rear upright member 21*b* has an upper end connected to or unitary with a left end of the rearwardmost upper crossbrace 81*c*. In a presently preferred embodiment, the length of the unit 30 measured between the front edge of the left front member 22*b* and the rear edge of the left rear member 21*b* desirably is about twenty-eight and seven eighths inches.

A propane fuel tank 60 desirably is connected in communication with the engine 40 and carried by the frame 20 above the engine 40. The propane fuel tank 60 desirably is selectively removable from the frame 20. As shown in FIG. 1 for example, a propane fuel tank 60 for the engine 40 desirably is mounted to the upper portion of the rear end 21 of the frame 20 above where the housing 50 for the electric stator and rotor will reside in the assembled unit 30. The propane fuel tank 60 desirably nests between the upper portion of the rear end 21 of the frame 20 and a vertical mid brace 28 of the frame 20. As shown in FIG. 1, the propane fuel tank 60 desirably can be seated on a cradle that desirably can be formed by a pair of cradle supports 61, 62 that can be secured atop a fuel tank support platform 65 that is carried by respective rear sections 27*a*, 27*b* (FIG. 2) of respective horizontal mid braces of the frame 20.

Figure 5:
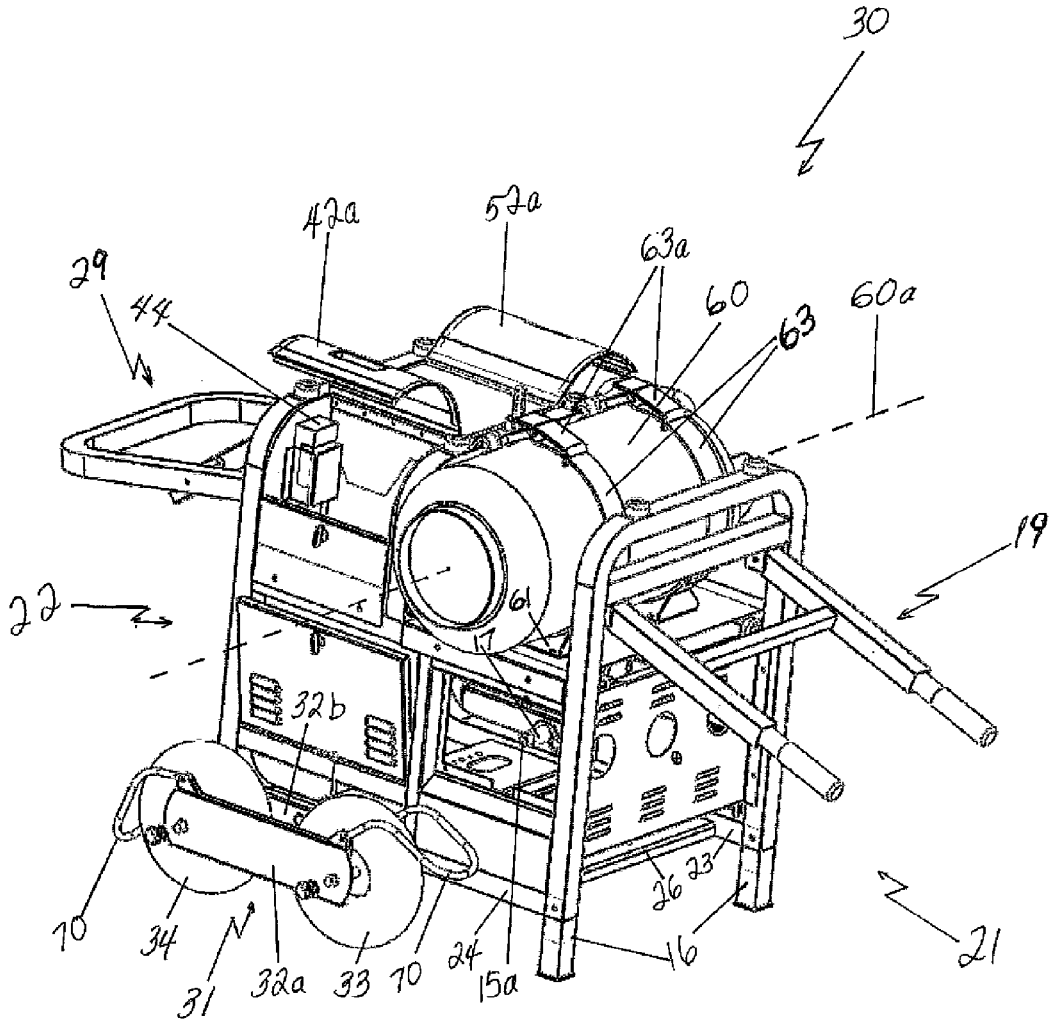
FIG. 5 is an elevated perspective view of the rear and left side of assembled components of a partially assembled, presently preferred embodiment of the wheeled, manually movable, internal combustion engine powered electric generator of the present invention.

The propane fuel tank 60 desirably has a capacity of at least nine gallons of liquid propane fuel, and a suitable embodiment of the propane fuel tank 60 desirably weighs about 40 pounds. As shown in FIGS. 1 and 5, the propane fuel tank 60 defines a central cylindrical axis of symmetry indicated by the dashed line designated 60*a*. The propane fuel tank desirably is carried on the frame 20 so that the central cylindrical axis of symmetry 60*a* is disposed in a plane that is defined by the axial direction (front to back) and the transverse direction (left to right) of the frame 20. The propane fuel tank 60 desirably has service diptube that is disposed within the interior of the propane fuel tank 60 and that communicates with the liquid space of the propane fuel tank 60 when the central cylindrical axis of symmetry 60*a* is mounted horizontally in the correct position.

As shown in FIG. 1, a retention rod 64 desirably is carried by the frame 20 and disposed to engage the propane fuel tank 60 when the propane fuel tank 60 is carried by the frame 20 with the service diptube in the correct position. The retention rod 64 desirably is a rigid rod made of steel that has one end fixed as by welding or other enduring means of fixation to the rear section 27*a* of the horizontal mid brace of the frame 20 and can have a rigid brace 64*a* that desirably connects the retention rod 64 to the fuel tank support platform 65. The retention rod 64 projects vertically above the fuel tank support platform 65 and the horizontal mid brace of the frame 20 and extends through a slot formed in the cylindrically shaped protection shield that is mounted at the tap end of the propane fuel tank 60. When the propane fuel tank 60 is so engaged, the retention rod 64 prevents the propane fuel tank 60 from moving along its cylindrical axis of symmetry 60*a* in the frame's transverse direction between the left and right sides of the frame 20.

A vacuum controlled, flow regulator valve 55 desirably is carried by the frame 20 and desirably is selectively connectable and disconnectable to the propane fuel tank 60. The flow regulator valve 55 desirably is linked by a vacuum hose to the carburetor of the internal combustion engine 40 so that the vacuum feedback from the carburetor will control the regulator valve 55 to provide the desired amount of propane gas to be mixed with air in the carburetor before this air/fuel mixture is provided to the internal combustion engine 40 and combusted therein. Because the flow regulator valve 55 is linked by a vacuum hose to the carburetor itself, the air/fuel mixture in the carburetor is automatically adjusted as load changes are made. The flow regulator valve 55 automatically senses changes in engine intake vacuum that are directly related to engine load changes. So, if more load is added, the carburetor throttle changes, which causes an increase in intake manifold vacuum. This increase in the intake manifold vacuum in turn causes the flow regulator valve 55 to increase the flow of propane gas so as to keep the air/fuel mixture ideal for keeping the engine 40 running.

As shown in FIG. 1 for example, the propane service valve that controls the flow of liquid propane from the propane fuel tank 60 is connected to the propane fuel tank 60 and includes a knob 60*b* by which the operator manually opens and closes the propane service valve. The propane service valve desirably is attached via a gas regulator 60*c* that desirably provides to the propane gas line 40*a*, a constant supply of propane gas at 12 pounds per square inch. The propane gas line 40*a* is in turn connected to the mixing regulator valve 55 from which the propane gas is provided to the carburetor of the internal combustion engine 40.

As shown in FIG. 1 for example, the upper front section of the frame 20 desirably supports and contains a regulator compartment 52 that houses the mixing valve 55 for the dispensing of the propane fuel to the internal combustion engine 40. A hinged 52*a* cover desirably encloses the regulator compartment 52, and a locking mechanism 52*b* desirably is provided to secure the cover 52*a* in the closed position. The propane fuel tank 60 is connected via a propane fuel line (not shown) to the engine 40 in conventional fashion. The propane fuel tank 60 desirably holds more than nine gallons of propane fuel. When fully assembled with the propane fuel tank 60 received in the cradle, the remaining components are disposed beneath or flush with the uppermost elements of the frame 20, and thus the upper rear portion of the frame 20 allows stacking of one generator unit 30 atop another generator unit 30.

Figure 4:
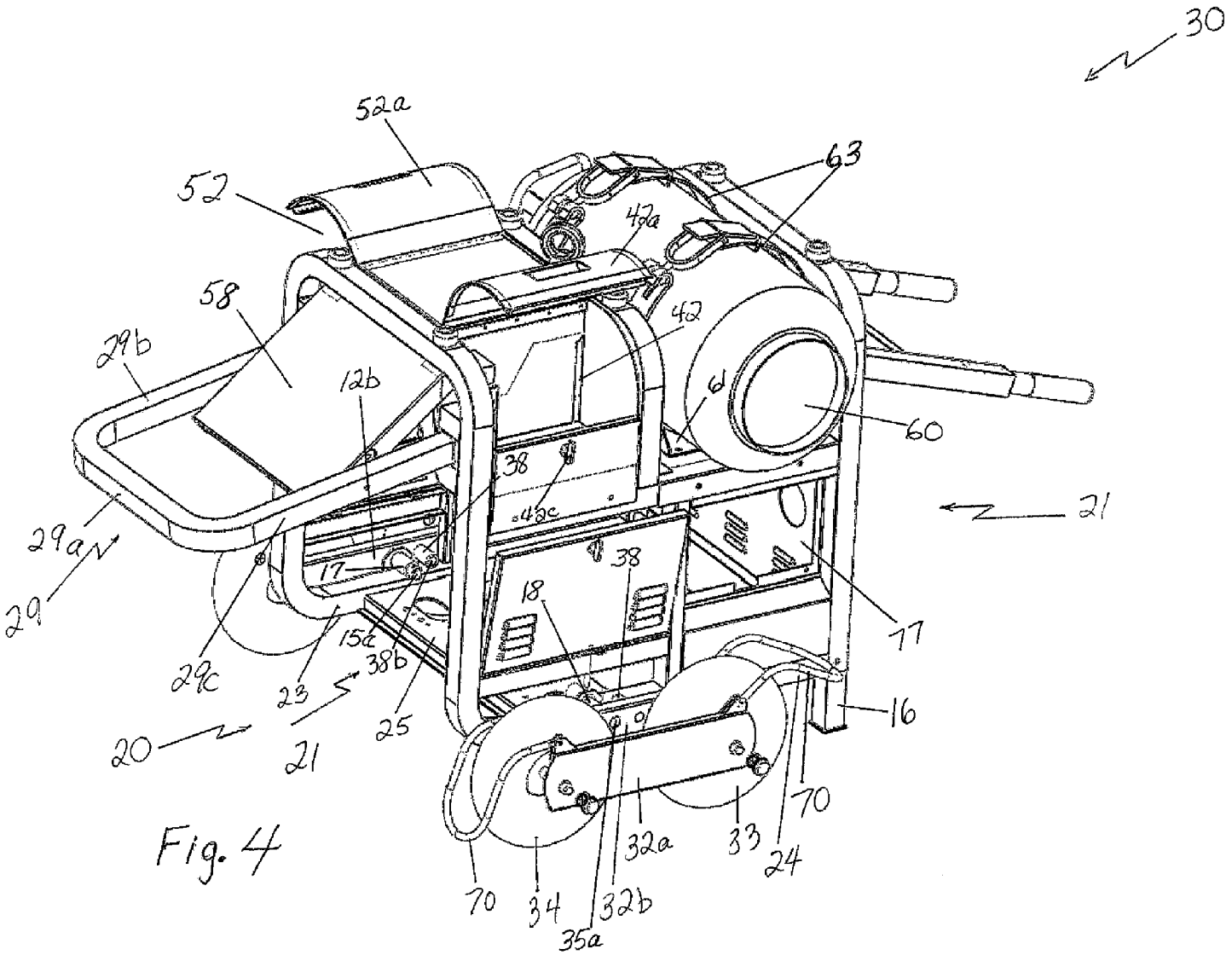
FIG. 4 is an elevated perspective partial view from the left front of components of a partially assembled, embodiment of the wheeled, manually movable, internal combustion engine powered electric generator of the present invention.

As shown in FIGS. 1 and 5 for example, the propane fuel tank 60 desirably is held on the cradle by at least one pair of securement straps 63 wherein each securement strap 63 has a pair of opposed ends, and one end of each securement strap 63 is anchored to the frame 20. A selectively adjustable connector 63*a* desirably is configured so that it selectively can be connected to the opposite ends of each securement strap 63. As shown in FIG. 4 for example, the selectively adjustable connector 63*a* can be formed as a selectively adjustable, tensioning buckle or a ratchet lever hoist mechanism for example. The tension applied to the securement straps 63 is increased as the adjustable connector 63*a* is closed and thus grips the propane fuel tank ever more tightly. The tension applied to the securement straps 63 is loosened as the adjustable connector 63*a* is released, and thus the securement straps 63 and the connector 63*a* desirably are configured to permit the propane fuel tank 60 to be selectively removable from the frame 20.

As shown in FIGS. 1, 2, 3 and 4 for example, the rear end 21 of the frame 20 typically will have a pair of stationary vertical support legs 16 to carry the portion of the weight of the generator unit 30 disposed to the rear end 21. As shown in FIG. 3 for example, each support leg 16 desirably is provided with a support foot 16*a* fixed at the free end of each support leg 16. Each support foot 16*a* desirably is configured with more surface area to rest against the ground than the free end of the support leg 16 to which the support foot 16*a* is attached.

In addition to the frame 20, the engine 40, the stator and rotor, the wheeled, manually movable, internal combustion engine powered electric generator 30 comprises a first wheel assembly 11 and a second wheel assembly 31. As shown in FIGS. 1, 3 and 4 for example, the wheel assemblies 11, 31 desirably are disposed beneath the front end 22 of the frame 20 to carry the portion of the weight of the generator unit 30 disposed to the front end 22. In a desirable aspect of embodiments of the present invention, and as shown in FIG. 6 for example, the frame 20 and each of the wheel assemblies 11, 31 are configured so that the first wheel assembly 11 is pivotally connected to the first side of the frame 20 and the second wheel assembly 31 is pivotally connected to the second side of the frame 20. Moreover, the frame 20 and each of the wheel assemblies 11, 31 are configured so that each of the wheel assemblies 11, 31 is quickly and easily disassembled from the frame 20 for ease of shipment and storage and quickly and easily re-assembled to the frame 20 once arriving on site for operation.

Figure 7:
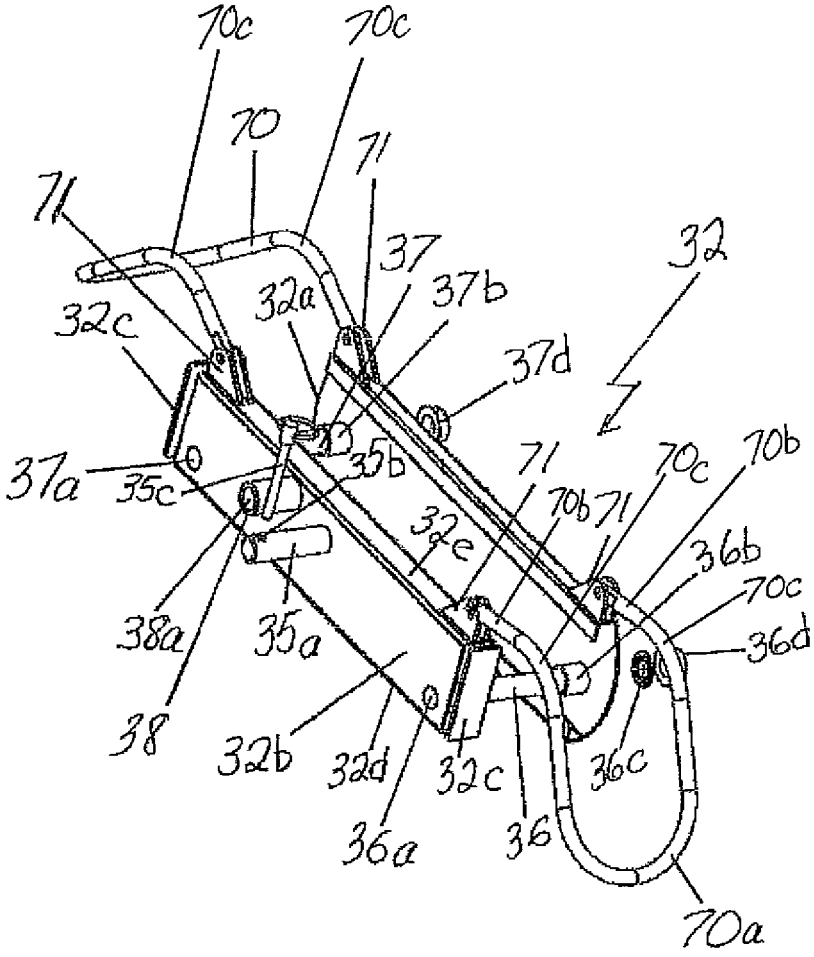
FIG. 7 is an elevated perspective view of a wheel support component of a presently preferred embodiment of the wheeled, manually movable, internal combustion engine powered electric generator of the present invention.
Figure 8:
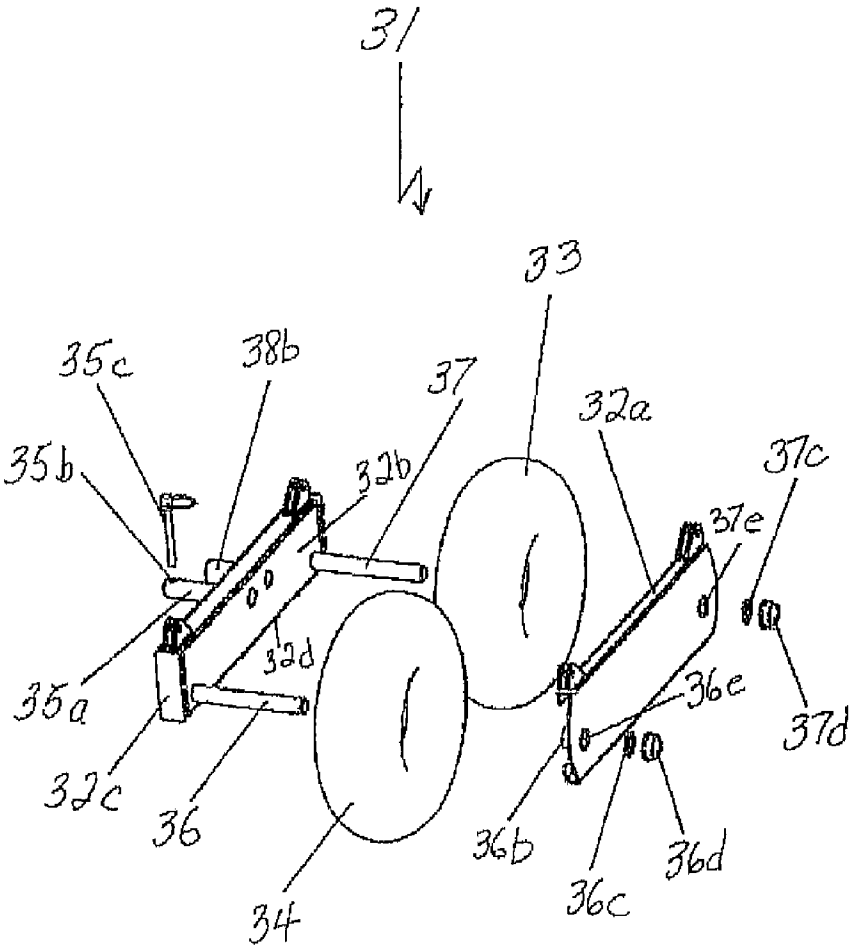
FIG. 8 is an elevated perspective view of an assemblage of components of an embodiment of a wheel assembly of a presently preferred embodiment of the wheeled, manually movable, internal combustion engine powered electric generator of the present invention.

FIG. 7 illustrates an elevated perspective view of a presently preferred embodiment of a left wheel support 32 before the wheels 33, 34 are attached and before the left wheel support 32 is pivotally attached to a presently preferred embodiment of the lower left rail 24 of the frame 20. FIG. 8 illustrates an elevated perspective view of the disassembled components of a presently preferred embodiment of a left wheel assembly 31 before the wheels 33, 34 are attached and before the outer left wheel support 32*a* is attached to the inner left wheel support 32*b* and before the inner left wheel support 32*b* is pivotally attached and selectively detachably attached, to the lower left rail 24 of the frame 20.

As shown in FIGS. 7 and 8 for example, the left wheel support 32 desirably includes an outer left wheel support 32*a* and an inner left wheel support 32*b* that is opposed to and spaced apart from the outer left wheel support 32*a*. Each of the outer left wheel support 32*a* and the inner left wheel support 32*b* desirably can be formed by a length of rectangular cross-section extrusion of 18 gauge cold rolled, tubular steel having about a 60,000 psi rating. The inner wheel support plate 32*b* defines an outer side and an inner side disposed opposite the outer side. As shown in FIG. 7 for example, in a presently preferred embodiment, the inner left wheel support 32*b* has a height of about 3 inches measured between the lower edge 32*d* and the upper edge 32*e*, a length of about 14 inches between the opposite ends, and a thickness or depth of about one inch measured between the outer side and the inner side. Each opposite end of the inner left wheel support 32*b* desirably can be sealed by an end cap 32*c* that is press fit onto the open end of the tubular extrusion that desirably forms the inner left wheel support 32*b*, and the end cap 32*c* desirably is formed of plastic or rubber. Similar end caps 32*c* can be applied to the outer left wheel support 32*a* if desired.

The left wheel support 32 desirably is pivotally mounted to the lower left side of the frame 20. As shown in FIGS. 7 and 8 for example, a left wheel assembly journal 35*a* can be mounted permanently (as by welding for example) to the inner side of the inner left wheel support 32*b* and extending axially in a direction transversely from the plane that defines the inner side of the inner left wheel support 32*b*. The inner side of the inner left wheel support 32*b* is the side that will be disposed closer to the frame 20 when the left wheel assembly 31 is pivotally connected to the frame. In a presently preferred embodiment, the central axis of rotation of the left wheel assembly journal 35*a* is disposed about two inches above the lower edge 32*d* of the inner left wheel support 32*b* and is disposed equidistantly from each of the opposed ends of the inner left wheel support 32*b*.

As shown in FIGS. 7 and 8 for example, one end 36*a* of a front wheel axle 36 can be permanently attached (as by welding for example) to the outer side of the inner left wheel support 32*b*, and one end 37*a* of a rear wheel axle 37 can be spaced apart from the front wheel axle 36 and permanently attached (as by welding for example) to the outer side of the inner left wheel support 32*b*. As shown in FIGS. 7 and 8 for example, the outer left wheel support 32*a* can include a front axle sleeve 36*b* that is configured to receive the free end of the front axle 36 therethrough, and the free end of the front axle 36 continues through an opening 36*e* defined through the outer left wheel support 32*a*. Similarly, the outer left wheel support 32*a* can include a rear axle sleeve 37*b* that is configured to receive the free end of the rear axle 37 therethrough, and the free end of the rear axle 37 continues through an opening 37*e* defined through the outer left wheel support 32*a*.

As shown in FIG. 8 for example, the two left wheels 34, 33 include a front left wheel 34 and a rear left wheel 33 that are rotatably disposed between the outer left wheel support 32*a* and the inner left wheel support 32*b*. In a presently preferred embodiment, each wheel 33, 34 desirably is formed of solid rubber, has a diameter of about 10 inches and a tread surface width of about 3.5 inches. The front left wheel 34 is rotatably disposed on the front wheel axle 36, and the rear left wheel 33 is rotatably disposed on the rear wheel axle 37.

In a presently preferred embodiment, the diameter of the left wheel assembly journal 35*a* and the right wheel assembly journal 15*a* desirably is about three-quarters of an inch, and the diameter of each of the front axle 36 and rear axle 37 desirably is about five-eighths of an inch. As shown in FIGS. 7 and 8 for example, the axis of rotation of the left wheel assembly journal 35*a* desirably is disposed equidistant from each of the axes of rotation of the front and rear axles 36, 37, which desirably are spaced apart at their central axes by about 12.625 inches in a presently preferred embodiment. In a presently preferred embodiment, the central axis of rotation of each of the front wheel axle 36 and rear wheel axle 37 desirably is disposed about three quarters of an inch above the lower edge 32*d* of the inner left wheel support 32*b* and desirably is disposed equidistantly from each of the opposed ends of the inner left wheel support 32*b*.

As shown in FIGS. 7 and 8 for example, while the axes of rotation of the front and rear axles 36, 37 desirably are disposed closer to the lower edge 32*d* of the inner left wheel support 32*b*, the axis of rotation of the left wheel assembly journal 35*a* desirably is disposed closer to the upper edge 32*e* of the inner left wheel support 32*b*. In a presently preferred embodiment, the vertical distance between the central axis of rotation of the left wheel assembly journal 35*a* and the central axis of rotation of each of the front and rear axles 36, 37 desirably is about 1.25 inches. Thus, the center points of the axis of rotation of the left wheel assembly journal 35*a* and the axes of rotation of the front and rear axles 36, 37 desirably form the vertices of an isosceles triangle drawn in the plane of the inner left wheel support 32*b*.

Referring to FIGS. 7 and 8 for example, to assemble the left wheel assembly 31 for example, the front wheel axle 36 is passed through the front wheel bearing of the front wheel 34 and through the front axle sleeve 36*b* and the aligned concentric opening 36*e* in the outer left wheel support 32*a*, and the free end of the front axle 36 is secured by a fastener 36, which desirably can be a washer that is press-fit onto the free end of the front axle 36. The free end of the front wheel axle 36 can be covered with a cap 36*d*. The same procedure can be followed for the rear wheel 33, the rear wheel axle 37, the rear axle sleeve 37*b* in the outer left wheel support 32*a*, the fastener 37*c* for the free end of the rear axle 36, and a cap 37*d*. When the components of the left wheel assembly 31 in FIG. 8 are full assembled, a presently preferred embodiment of left wheel assembly 31 desirably weighs about 22 pounds. The addition of the wheel locks 70 (described more fully below) would add less than an additional pound to the weight of the left wheel assembly 31.

When the left wheel assembly 31 is so assembled, the axes of rotation of the front and rear axles 36, 37 are perpendicular to the parallel planes that define the outer left wheel support 32*a* and the inner left wheel support 32*b* and parallel to the axis of rotation of the left wheel assembly journal 35*a*. As shown in FIG. 3 for example, left front wheel 34 of the left wheel assembly 31 desirably is spaced apart in the axial direction of the frame from the left rear wheel 33 of the left wheel assembly 31. Moreover, as shown in FIGS. 3 and 6 for example, the front left wheel 34 and the rear left wheel 33 desirably are aligned with each other such that the central circumferential line (the equator if you will) of each wheel falls in generally the same plane.

The right wheel assembly 11 is a mirror image of the left wheel assembly 31. As shown in FIGS. 1 and 6 for example, the right wheel assembly 11 desirably is pivotally mounted and selectively detachably connected to the lower right side of the frame 20. As shown in FIG. 1 for example, the right wheel assembly 11 can include a right wheel support 12 and two right wheels 13, 14 rotatably mounted to the right wheel support 12. The right wheel support 12 desirably includes an outer right wheel support 12*a* and an inner right wheel support 12*b* that is opposed to and spaced apart from the outer right wheel support 12*a* and that defines an outer side and an inner side disposed opposite the outer side. A front wheel axle extends transversely from the outer side of the right inner wheel support plate 12*b*, and the right wheel assembly 11 includes a rear wheel axle extending transversely from the outer side of the right inner wheel support plate 12*b* and spaced apart from the front wheel axle. The two right wheels disposed between the outer right wheel support 12*a* and the inner right wheel support 12*b* include a rear right wheel 13 rotatably disposed on the rear wheel axle and a front right wheel 14 rotatably disposed on the front wheel axle. As shown in FIGS. 1 and 6 for example, the rear right wheel 13 and the front right wheel 14 desirably are aligned with each other such that the axis of rotation of each wheel is spaced apart from and parallel to the axis of rotation of the other wheel in the right wheel assembly 11.

Though not visible in the view shown in FIG. 1, the right wheel assembly 11 includes a right wheel assembly journal 15*a* (see FIG. 4) extending axially from the inner side of the right inner wheel support plate 12*b* and extending in a transverse direction parallel to the front wheel axle 36 and the rear wheel axle 37. The inner side of the inner right wheel support 12*b* is the side that will be disposed closer to the frame 20 when the right wheel assembly 11 is pivotally connected to the frame. As shown in FIG. 4, the right wheel assembly journal 15*a* is pivotally connected to the lower right rail 23 of the right side of the frame 20.

Figure 9:
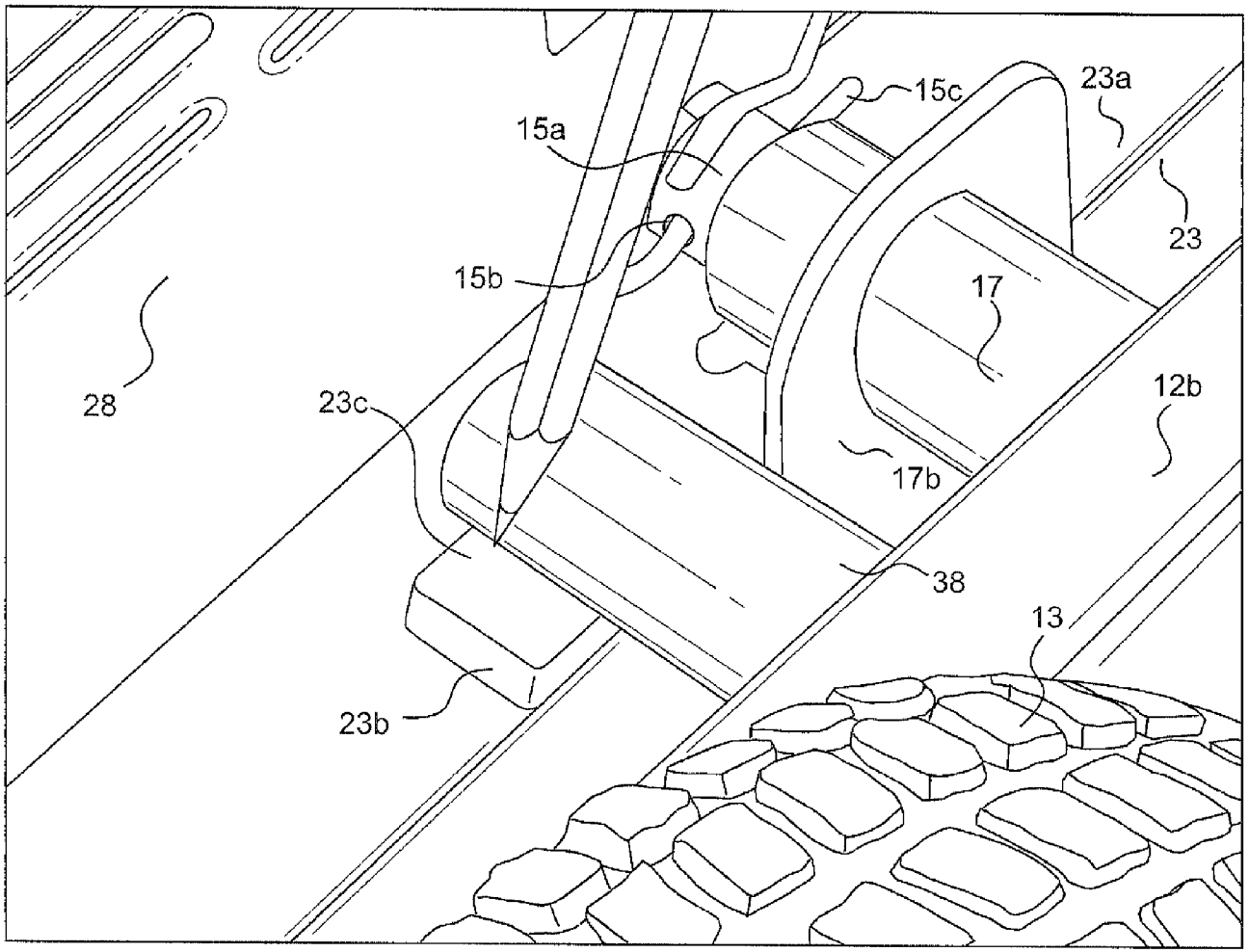
FIG. 9 is an enlarged, elevated, perspective, partial view of assembled components of a presently preferred embodiment of a wheeled, manually movable, internal combustion engine powered electric generator unit of the present invention.

As shown in FIGS. 2, 4 and 9 for example, a right wheel bearing 17 is formed by a hollow section of a stainless steel tube that is rigidly and permanently mounted (as by welding for example) to a section of the right bottom rail 23 at the lower portion of the right side of the frame 20. The right wheel assembly journal 15*a* of the right wheel support 12 desirably is configured to rotate within the opening 17*a* (see e.g., FIG. 2) that is defined through the right wheel bearing 17, and accordingly the right wheel assembly 11 is pivotally connected to the right side of the frame. In a presently preferred embodiment, the linear horizontal distance between the central rotational axis of the opening 17*a* through the right wheel bearing 17 and the farthest surface of the right vertical rear leg 21*a* of the frame 20 desirably measures about 19.5 inches. In such an embodiment, the horizontal length from the forwardmost edge of the right front vertical leg 22*a* and the central rotational axis of the opening 17*a* through the right wheel bearing 17 desirably measures about 9.375 inches long.

As similarly shown in FIG. 2 for example, a left wheel bearing 18 is formed by a hollow section of a stainless steel tube that is rigidly and permanently mounted (as by welding for example) to left bottom rail 24 at the lower portion of the left side of the frame 20. The left wheel assembly journal 35*a* of the left wheel support 32 shown in FIGS. 7 and 8 for example desirably is configured to rotate within the opening 18*a* (see e.g., FIG. 2) that is defined through the left wheel bearing 18, and accordingly the left wheel assembly 31 is pivotally connected to the left side of the frame. Referring to FIG. 2 for example, in a presently preferred embodiment, the linear horizontal distance between the central rotational axis of the opening 18*a* through the left wheel bearing 18 and the farthest surface of the left vertical rear leg 21*b* of the frame 20 desirably measures about 19.5 inches. In such an embodiment, the horizontal length from the forwardmost edge of the left front vertical leg 22*b* and the central rotational axis of the opening 18*a* through the left wheel bearing 18 desirably measures about 9.375 inches long.

Each of the respective right and left wheel assembly 11, 31 desirably includes a respective quick-disconnect member 15*c*, 35*c* that is configured to selectively permit quickly disconnecting that wheel assembly from its respective side of the frame. As shown in FIGS. 7 and 8, a hole 35*b* is defined through the left wheel assembly journal 35*a* near the free end thereof, and the hole 35*b* is configured to receive therein a cotter pin 35*c*. After the left wheel assembly journal 35*a* of the left wheel support 32 is inserted through the opening 18*a* in the left wheel bearing 18, a cotter pin 35*c* desirably is inserted through the hole 35*b* to complete the rotational and pivoting attachment of the left wheel support 32 of the left wheel assembly 31 to the lower left rail 24 of the frame 20. As shown in FIG. 9 for example, a cotter pin 15*c* similarly is used to complete the rotational and pivoting attachment of the right wheel assembly journal 15*a* of the right inner wheel support 12*b* of the right wheel assembly 11 to the right bottom rail 23 of the frame 20. In this way, the user's selective removal or insertion of the cotter pin 15*c* or 35*c* provides for quick removal or assembly, respectively, of the respective wheel assembly from and to the frame 20 for ease of shipping and ease of on-site re-assembly.

As shown in FIG. 2 for example, the respective right wheel bearing 17 that rotatably receives the right wheel assembly journal 15*a* (e.g., FIG. 9) of the right wheel assembly 11 and left bearing 18 that rotatably receives and supports the left wheel assembly journal 35*a* (e.g., FIG. 7) of the left wheel assembly 31 will be disposed between the front end 22 of the frame 20 and the center of gravity of the overall unit 30, whether the generator's propane fuel tank 60 is full of propane fuel or empty. With these locations of the right and left journal bearings 17, 18, each of the right wheel assembly 11 and left wheel assembly 31 will become pivotally mounted to the frame 20 such that the pivot points at the centers of the axes of rotation of the respective journals 15*a*, 35*a* facilitate maneuvering over rough terrain with a full tank of propane fuel without fear of the generator 30 tipping over the front wheels 14, 34. Moreover, each of the right wheel assembly 11 and left wheel assembly 31 desirably pivots independently of the other wheel assembly. Thus, each of the right wheel assembly 11 and left wheel assembly 31 can negotiate over relatively raised obstructions or through depressions in the path independently of each other.

Each of the respective right and left wheel assembly 11, 31 desirably includes a respective pivot pin that extends from the inner side of the respective inner wheel support plate 12*b*, 32*b* of that wheel assembly. Each respective pivot pin desirably is configured and disposed to contact the respective upper surface 23*a*, 24*a* of the respective bottom rail 23, 24 when the rear support feet 16 are lifted off the ground by a predetermined distance. That predetermined distance can be set based on the anticipated obstacles likely to be presented by the terrain where the generator is intended to be deployed. Additionally, each respective pivot pin desirably is disposed closer to the respective rear wheel axle 37 of the respective wheel assembly 11, 31 than to the front wheel axle 36 of the respective wheel assembly.

As shown in FIG. 7, a short length of cylindrical steel tubing can be disposed as a left side pivot pin 38*a* having one opposite end mounted (as by welding for example) to the inner left wheel support 32*b* and extending axially from the inner side thereof in the same direction as and parallel to the left wheel assembly journal 35*a*. The left side pivot pin 38*a* has a diameter of about one half inch and desirably is surrounded by an annular rubber sleeve 38 such that the combined diameter of the left side pivot pin 38*a* and sleeve 38 is about three-quarters of an inch to about one inch.

As shown in FIG. 7, the left side pivot pin 38*a* is disposed between the left wheel assembly journal 35*a* and the end 37*a* of the rear wheel axle 37 that is attached to the inner left wheel support 32*b*. Moreover, as shown in FIG. 7, the left side pivot pin 38*a* is disposed closer to the upper edge 32*e* of the inner left wheel support 32*b* than is the left wheel assembly journal 35*a*. In a presently preferred embodiment, the central axis of rotation of the left side pivot pin 38*a* is disposed about 2.375 inches above the lower edge 32*d* of the inner left wheel support 32*b* and is disposed about 5.25 inches from the closest one of the opposed ends of the inner left wheel support 32*b*. Accordingly, in a presently preferred embodiment, the vertical distance between the central axis of rotation of the left side pivot pin 38*a* and the central axis of rotation of the left wheel assembly journal 35*a* is about three eighths of an inch. Similarly, as shown in FIG. 4, a right side pivot pin 38*b* has one opposite end mounted (as by welding for example) to the inner side of the inner right wheel support 12*b* and extending in the same direction as and parallel to the right wheel assembly journal 15*a* and is covered by an annular rubber sleeve 38.

In an alternative embodiment shown in FIG. 9, a shim 23*b* desirably can be disposed on the upper surface 23*a* of the right bottom rail 23 and positioned so that the upper surface 23*c* of the shim 23*b* can be contacted by the rubber sleeve 38 of the right pivot pin 38*b*. The pencil point shown in FIG. 9 is pointing at the upper surface 23*c* of the shim 23*b*. Though not shown in the same detail as in FIG. 9, a similar shim 24*b* desirably can be disposed on the upper surface 24*a* of the left bottom rail 24 and positioned so that the upper surface 24*c* of the shim 24*b* can be contacted by the rubber sleeve 38 of the left pivot pin 38*a*. In a presently preferred implementation of this alternative embodiment, the upper surface 23*c*, 24*c* of each such shim 23*b*, 24*b* desirably is disposed about one quarter inch above the respective upper surface 23*a*, 24*a* of the respective bottom rail 23, 24. With the desired relative disposition of the pivot pins 38*a*, 38*b* in relation to the respective wheel assembly journals 35*a*, 15*a* and their respective bearings 18, 17, (e.g., FIG. 2) for the journals 35*a*, 15*a*, when the generator is resting on all four wheels 34, 33, 14, 13 as in FIG. 3 for example, the lowermost surface of the annular rubber sleeve 38 covering each respective pivot pin 38*a*, 38*b* of the left wheel support 32 and the right wheel support 12 respectively, is desirably spaced vertically less than an eighth of an inch above the upper surface 24*c*, 23*c* of the shims 24*b*, 23*b* on the corresponding bottom rail 24, 23. The presence or absence of the shims 24*b*, 23*b* and the thickness of the shims 24*b*, 23*b* provides flexibility in the construction of the frame 20 and the wheel assemblies 11, 31 in order to accommodate engines 40 and generators of different weight distributions in relation to the frame 20.

Figure 10:
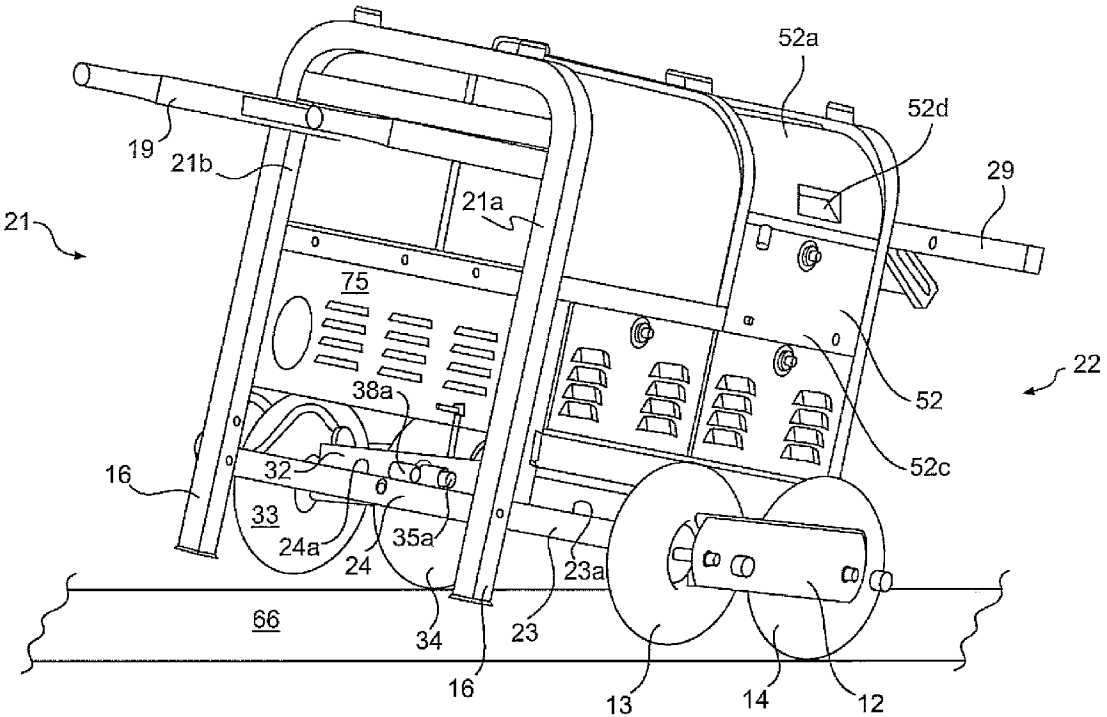
FIG. 10 is an elevated perspective view of from the rear and right side of assembled components of a partially assembled, presently preferred embodiment of the wheeled, manually movable, internal combustion engine powered electric generator of the present invention in a tilted position to pivot on the set of front wheels.

FIG. 10, which depicts a view without the fuel tank 60, the generator housing 50 and the motor 40 installed in the frame 20, shows for example a view when the generator frame's rear end 21 is lifted vertically away from the ground 66 using the rear handle 19. When this lifting movement begins to occur, each respective pivot pin 38*a*, 38*b* (or the sleeve 38 surrounding same) of the left wheel support 32 and the right wheel support 12 respectively almost immediately comes into contact with and engages the respective upper surfaces 23*a*, 24*a* atop the frame's corresponding bottom rail 24, 23 (or the upper surfaces 24*c*, 23*c*, which are not visible in FIG. 10, of the respective shims 24*b*, 23*b*, which likewise are not visible in FIG. 10, atop the frame's corresponding bottom rail 24, 23) so that the respective rear wheels 33, 13 become lifted away from contact with the ground 66. Thus, each respective pivot pin 38*a*, 38*b* of each respective wheel assembly 31, 11 is disposed to engage the frame and lift one end of that wheel assembly with respect to the ground 66 when one end of the frame is lifted a predetermined distance above the ground level. In so doing, it becomes easier for the generator unit 30 to be pivoted on just the two front end wheels 34, 14 so that the entire generator unit 30 can be pivoted from side to side, left or right, on the two front end wheels 34, 14.

Moreover, emergency stand alone electric generators often must be located in remote areas, such as when deployed to provide emergency power to residential cabins in rural areas. If the retractable rear handle 19 at the rear end 21 of the frame is being used to pull the generator over the terrain in the path of the generator's wheels 13, 14, 33, 34 when negotiating a relatively elevated section of the path (such as a rock or fallen tree limb) on the left side of the frame for example, the rear left wheel 33 can raise above the front left wheel 34 as the frame moves past the relatively elevated section of the path. In so doing, it also becomes easier for the generator to be pulled from the rear end 21 on just the two front end wheels 34, 14 so that the rear wheels 33, 13 become elevated to encounter an elevated obstruction and ease the transition of the generator over an elevated obstruction in the generator's path. This feature of one aspect of an embodiment of the generator allows the generator to be deployed in relatively rougher terrain than otherwise would be possible.

In accordance with one aspect of an embodiment of the generator, a wheel locking mechanism can be provided that enables both the front and rear wheels of a wheel assembly 11 or 31 to be locked against rotation once the unit 30 is situated where desired, e.g., next to a rural cabin that would need to be provided with the electricity generated by the generator unit 30. As shown in FIGS. 3, 4 and 5 for example, a retractable, wheel lock 70 desirably can be pivotally mounted to a pair of opposed wheel lock flanges 71 (FIGS. 3 and 7) that are fixed to the outer left wheel support 32*a* and inner left wheel support 32*b*, respectively. In one embodiment, a separate wheel lock 70 desirably is provided for each of the left wheels 33, 34. However, in another presently preferred alternative embodiment (not shown), a separate wheel lock 70 desirably can be provided for each of the right wheels 13, 14. While a separate wheel lock 70 can be provided for each of the four wheels 13, 14, 33, 34, if the generator is disposed on an incline, it may be advantageous to dispose the wheel locks 70 on only the wheels of one of the wheel assemblies 11 or 31. By so doing, the side of the generator without the locked wheels will tend to arc in a circle rather than follow the pull of gravity down the incline.

As shown in FIGS. 4, 5 and 7 for example, each wheel lock 70 desirably can be provided in the form of a U-shaped rod. As shown in FIG. 7, each wheel lock 70 desirably has a closed loop portion 70*a* at one end of the wheel lock 70 and at the opposite extreme of the wheel lock 70 has two free ends 70*b* opposed to each other and pivotally connected to the respective wheel assembly 11 or 31. Each U-shaped rod further defines an intermediate section 70*c* disposed between the free ends 70*b* and the closed loop portion 70*a*, and the intermediate section 70*c* desirably is bent at an angle relative to the plane in which the closed loop portion 70*a* of the U-shaped rod 70 resides. When engaged as a wheel brake, the closed loop portion of the wheel lock 70 contacts a portion of the respective rolling surface of the wheel 33, 34 and prevents the respective wheel from rotating in the direction toward the closed loop portion. When both wheel locks 70 of the embodiments shown in FIG. 4 are engaged to the respective wheels 33, 34, the left side of unit 30 is prevented from rolling forward or backward.

Except for the wheel locks 70 and the relative positioning of the pivoting pivot pins 38*a*, 38*b* and the wheel assembly journals 35*a*, 15*a*, the right wheel support 12 is the same as the left wheel support 32 that is shown in FIG. 7. As shown in FIGS. 4 and 8, it is important that the pivoting pivot pins 38*a*, 38*b* be disposed between the wheel assembly journals 35*a*,

15*a* and the rear end 21 of the generator unit 30. The rear end 21 of the generator unit 30 has the rear support legs 16 on the ends of the vertical rear legs 21*a*, 21*b* of the frame 20.

As shown in FIGS. 3 and 6 for example, a muffler 46 on the internal combustion engine desirably is disposed behind the engine 40 and within the lower section of the frame and beneath the upper outline of the internal combustion engine 40 in order to provide free space for accommodating the propane fuel tank 60 (FIGS. 1 and 6) in the upper portion of the frame. As shown in FIGS. 3 and 6 for example, the engine's muffler 46 is mounted along one side of the housing 50 for the electric stator and rotor.

As shown in FIG. 1, a back panel 77 is provided for the generator, and the interior facing surface of the back panel 77 facing the generator desirably is provided with a layer of sound insulating material. Moreover, the interior facing surface of the lower left side panel 75 (shown in FIG. 10 for example) is desirably also provided with sound insulating material that muffles the noise of the operating generator.

As shown in FIG. 3, an electrical output connector 51 is provided and configured to electrically connect the electrical output produced by the generator to the electrical load such as batteries that are to be recharged for example or the electric service of a living space such as a rural cabin. A power cord or transmission cable 54 is provided having one end connected to the electrical output connector 51. An opposite end of the power cord 54 is electrically connected to the generator in conventional fashion. As shown in FIG. 6 for example, an electric control panel 56 for the connector 51 is housed on one side of the frame 20. The electric connector 51 desirably is electrically connected to the electric generator via the electric power transmission cable 54 and the electric control panel 56.

As shown in FIGS. 1 and 3 for example, the upper front portion of the frame 20 supports and contains the regulator compartment 52 that is carried by the frame. The regulator compartment 52 can be provided with a lower attachment flange 52*c* that can be secured to a front section 27*d* of a horizontal mid brace of the frame 20. The regulator compartment 52 desirably nests between the upper portion of the front end 22 of the frame 20 and the vertical mid brace 28 of the frame 20. The regulator compartment 52 defines a storage space that selectively houses the electrical output connector 51 and the power transmission cable or cord 54. As shown in FIG. 1 for example, the regulator compartment 52 also defines an opening providing access to the mixing valve 55 that is housed within the regulator compartment 52. The interior of the regulator compartment 52 also desirably is provided with an additional empty volume of space that can be used for storing items in addition to the electrical output connector 51 and the power transmission cable or cord 54.

As shown in FIGS. 1, 3, 4 and 5 for example, the regulator compartment 52 desirably includes a door in the form of a hinged cover 52*a* connected to the regulator compartment and selectively closing and exposing the opening that provides access to the interior of the regulator compartment 52. The regulator compartment 52 desirably includes a locking mechanism for selectively locking the door 52*a* in a position closing the opening in the regulator compartment 52. As shown in FIG. 1 for example, a locking mechanism 52*b* desirably is provided that locks the hinged cover 52*a* and thereby secures the regulator compartment 52 in the closed position. As shown in FIGS. 1 and 10 for example, a recessed hand hold 52*d* can be provided in the hinged cover 52*a* to facilitate manually raising and lowering the cover 52*a*.

In an advantageous feature of an embodiment of the present invention, to discourage tampering with whatever items might be housed or stored within the regulator compartment 52, the regulator compartment 52 further defines a front wall portion that is configured to permit the cover 52*a* to be closed and locked while the connector 51 and power cord 54 are disposed outside the regulator compartment 52 and connected to supply electric power to a load.

As shown in FIG. 3 for example, a direct current battery 41 for the internal combustion engine 40 desirably is carried above the engine 40 by the upper portion of the front end 22 of the frame 20 and connected to the engine 40 in a conventional fashion. As shown in FIG. 3, a battery compartment 42 defines an interior space and an opening providing access to the interior space where the battery 41 desirably is housed. The battery compartment 42 desirably can be provided with a lower attachment flange 45 that can be secured to a front section 27*c* of a horizontal mid brace of the frame 20. The battery compartment 42 desirably nests between the upper portion of the front end 22 of the frame 20 and the vertical mid brace 28 of the frame 20. As shown in FIGS. 1 and 4, the battery compartment 42 desirably is mounted to the upper front section of the frame 20 flush with the uppermost elements of the frame 20 and completely within the outer envelope that defines the frame 20.

The battery compartment 42 desirably is provided with a hinged cover 42*a* that is connected to the battery compartment and can be manipulated for selectively closing and exposing the opening that exposes the interior of the battery compartment 42. As shown in FIG. 1 for example, a recessed hand hold 42*b* can be provided in the hinged cover 42*a* to facilitate manually raising and lowering the cover 42*a*. As shown in FIG. 4 for example, a locking mechanism 42*c* desirably is provided that locks the hinged cover 42*a* and thereby secures the battery compartment 42 in the closed position. By being disposed within the battery compartment 42 with the cover 42*a* closed and locked, the battery 41 desirably is secured for protection against theft when the unit 30 is deployed at an unattended location.

Desirably, as shown in FIGS. 3 and 5 for example, a trickle charger 44 for the battery 41 also can be housed within the battery compartment 42. FIG. 3 is an assembly view that depicts the battery 41 and trickle charger 44 outside of the compartment 42 and before the compartment 42 has been mounted into the frame 20. As shown in FIG. 3 for example, the trickle charger 44 is electrically connected to the battery 41 and keeps the battery 41 from discharging during periods when the unit 30 is going to remain in storage for any relevant length of time.

As shown in FIG. 2 for example, a selectively retractable front handle 29 is mounted pivotally to the upper portion of the front end 22 of the frame 20. One function of this front handle 29 is to facilitate lifting of the unit 30 when necessary to negotiate past obstacles that cannot be negotiated solely by using the rear handle 19 to push or pull the generator unit 30 on the wheels 13, 14, 33, 34. Though not shown in FIG. 2, the front handle 29 can be selectively retracted from its extended orientation shown in FIG. 2 to a position in which the front handle 29 lies flush with the front end 22 of the frame 20. As shown in FIG. 4, the front handle 29 can include an end brace 29*a* connecting a right front handle leg 29*b* that extends parallel to and spaced apart from a left front handle leg 29*c*.

Figure 11:
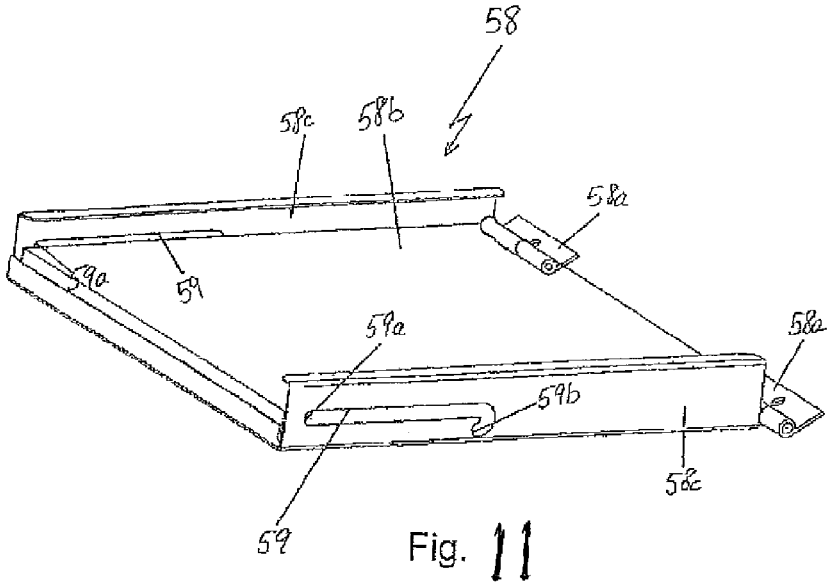
FIG. 11 is an elevated perspective view of a front panel component of a presently preferred embodiment of the wheeled, manually movable, internal combustion engine powered electric generator of the present invention.

In another advantageous feature of an embodiment of the present invention, a locking front panel 58 desirably is connected to the front handle 29 and configured to enable the user to selectively lock the front handle 29 in a fully extended horizontal position. FIG. 2 is an elevated perspective view from the front left side of the main frame 20, which has been stripped away of most components in order to illustrate better, the front handle 29 and the locking front panel 58. As shown in FIG. 2 for example, the locking front panel 58 is configured so that when the user positions the front panel 58 to lock the front handle 29 in the fully extended horizontal position, the user may release the user's grip on the front handle 29 without fear that the handle 29 will pivot downwardly to fully retract to the vertical position against the front 22 of the generator's frame 20. As shown in FIG. 2, the locking front panel 58 is pivotally mounted to the underside of the front upper crossbrace 81*a* of the front of the frame 20. As shown in FIG. 11, pivoting hinges 58*a* can be provided at one end of the locking front panel 58 for pivotally attaching the locking front panel 58 to the front upper crossbrace 81*a*. Moreover, as further shown in FIG. 11, a layer 58*b* of sound insulating material is desirably provided to line the underside of the locking front panel 58.

As shown in FIG. 11, an elongated slot 59 extends part way along the length of each opposite sidewall 58*c* of the locking front panel 58. Each slot 59 defines a first end 59*a*, which begins very near the end of the front panel 58 disposed away from the end that is pivotally mounted by the hinges 58*a*. As shown in FIG. 11, each slot 59 terminates just short of half way along the length of the panel 58. As shown in FIG. 11, the end of each slot that terminates just short of half way along the length of the panel 58 defines a locking leg 59*b* that is formed in the shape of the up-turned portion of the letter J.

Figure 12:
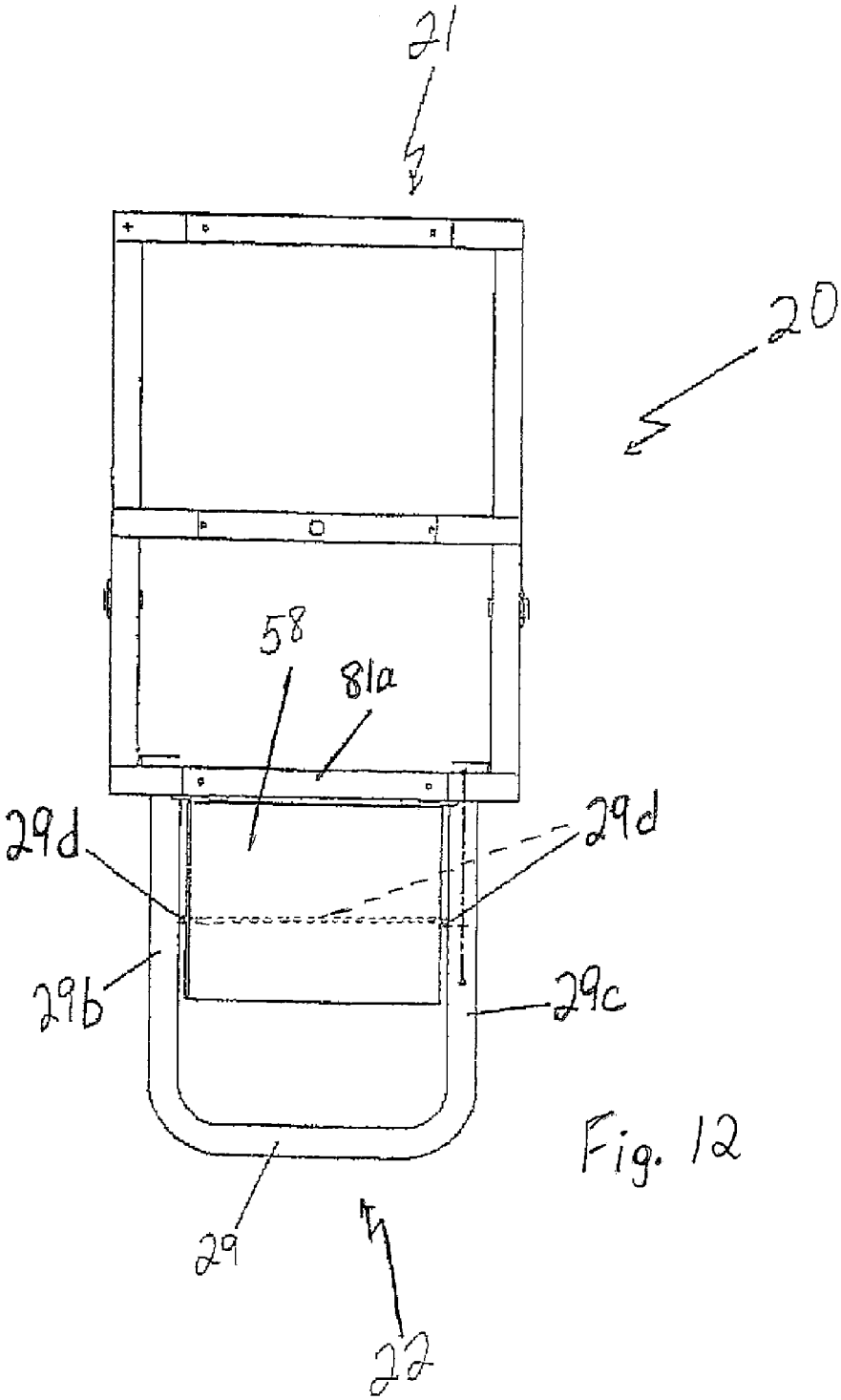
FIG. 12 is a top plan view of from above a frame component of a presently preferred embodiment of the wheeled, manually movable, internal combustion engine powered electric generator of the present invention.

As shown in FIG. 12, a guide bar 29*d* is mounted to extend from the side of the right front handle leg 29*b* of the front handle 29, and a guide bar 29*d* is mounted to extend from the side of the left front handle leg 29*c* of the front handle 29. Each guide bar 29*d* is slideably fitted within a respective one of the slots 59 formed in the sidewalls 59*c* of the locking front panel 58. In an alternative embodiment indicated by the dashed line, a single, elongated guide bar 29*d* extends completely through the locking front panel 58 with one of its free ends held by one of the right front handle leg 29*b* or the left front handle leg 29*c* of the front handle 29. When the front handle 29 is in the vertical position resting against the front end 22 of the frame, each guide bar 29*d* is positioned at the starting end 59*a* of the respective slot 59 of the locking front panel 58 nearest the end opposite the end where the hinges 58*a* are located. As the front handle 29 is raised from this vertical position into the horizontal position shown in FIGS. 1, 2, 4, 10 and 12, each guide bar 29*d* moves in the slot 59 toward the hinged end of the locking front panel 58 until the respective guide bar 29*d* is engaged by the user in the locking leg 59*b* portion of the end of the slot 59. Once the two guide bars 29*d* are resting in the locking leg 59*b* portions of the ends of the slots 59, then the front handle 29 becomes locked in the horizontal position shown in each of FIGS. 1, 2, 4, 10 and 12.

As shown in FIG. 1 for example, a retractable, rear handle 19 is pivotally mounted to be extendable from the upper portion of the rear end 21 of the frame 20. Though not shown in FIG. 1, the rear handle 19 can be selectively retracted from its extended orientation shown in FIG. 1 to a position in which the rear handle 19 lies flush with the rear end 21 of the frame 20. The rear handle 19 can include at least one forward cross brace 19*a* connecting a right grip handle 19*b* that extends parallel to and spaced apart from a left grip handle 19*c*. As shown in FIG. 1 for example, the rear handle 19 is pivotally mounted to the rear end 21 of the frame 20 by pivotally mounting one end of the right grip handle 19*b* to the right end of the upper rear cross brace 21*c* of frame 20 and pivotally mounting one end of the left grip handle 19*c* to the left end of the upper rear cross brace 21*c* of frame 20.

As shown in FIG. 3, the rear dual handles 19*b*, 19*c* can be locked in the upright horizontal position so that when the user stops gripping the handles 19*b*, 19*c*, they cannot fall from the horizontal position to the vertical position. Desirably, the frame and the ends of the handles 19*b*, 19*c* that are pivotally mounted to the frame can be provided with selectively alignable through holes that are configured to receive therein a locking pin that selectively can be put into place manually when the rear dual handles 19*b*, 19*c* are deployed in the horizontal position. In this way, when the user lets go of the handles, the handles will not pivot downwardly against the rear end of the frame.

As shown in FIG. 2 for example, each of the uppermost surfaces of the upper crossbraces 81*a*, 81*b*, 81*c* of the frame 20 desirably carries a pair of stacking disks 80, which desirably are resilient and skid resistant such as sturdy rubber disks 80 that facilitate one generator being stacked on top of another generator during shipping. The weight of the generator 30 with an empty propane fuel tank 60 is about 280 pounds, and so the six disks 80 desirably must be capable of withstanding at least this weight without degrading. Each disk 80 in the pair is spaced apart from the other disk 80 and desirably is as widely spaced apart as possible while still resting on a horizontal upper surface of the respective crossbrace 81*a*, 81*b*, 81*c*. The stacking disks 80 enable one generator 30 to be stacked on top of another generator 30 during shipping once the left and right wheel assemblies 31, 11 temporarily have been removed and without a propane fuel tank 60 with an overly large circumference being mounted in the cradle.

As shown in FIG. 2, a threaded opening 82*a* desirably is provided vertically through the mid upper crossbrace 81*b*. The threaded opening 82*a* desirably is configured for selectively detachably receiving a threaded end of a bolt portion of a lifting eye fixture 82 such as shown in FIG. 1 for example. The lifting eye fixture 82 facilitates lifting the generator unit 30 with a crane. The lifting eye fixture 82 is configured to be selectively detachable by being unscrewed from the threaded opening 82*a* formed in the mid upper crossbrace 81*b*. Detaching the lifting eye fixture 82 facilitates the stacking of one generator 30 on top of another generator 30, prior to shipping.

A hand guard panel desirably is attached to the end the frame nearer the internal combustion engine. The hand guard panel desirably is ventilated to facilitate air circulation to and from the engine while still shielding the user from coming into contact with the engine. As shown in FIG. 2, a ventilated hand guard panel 89 desirably is attached to the front right vertical leg 22*a* of the frame along one edge thereof. The hand guard panel 89 also desirably is provided with a plurality of openings 89*a* that facilitate air circulation to and from the engine. However, each opening 89*a* is not so large that a person could put a hand through the opening 89 and be harmed by operation of the internal combustion engine of the generator.

As shown in FIG. 2, for example, the vertical distance from the lowermost surfaces 23*d*, 24*d* of the respective bottom rails 23, 24 to the uppermost surfaces of the uppermost elements of the frame such as the upper surface of the front upper crossbrace 81*a* for example, desirably measures no more than about 25½ inches in height. When all four wheels are fully installed on the frame, the vertical distance from the portion of the wheel touching the ground to the uppermost surfaces of the uppermost elements of the frame such as the upper surface of the front upper crossbrace 81*a* for example, desirably measures no more than about 29½ inches high. In such an embodiment, the horizontal length between the forwardmost edge of each front vertical leg 22*a*, 22*b* and the rearwardmost edge of each respective rear vertical leg 21*a*, 21*b* desirably measures no more than about 29⅛ inches long. The distance between the leftmost surface of the front left vertical leg 22*b* and the rightmost surface of the right vertical leg 22*a* desirably measures no more than about 21½ inches wide.

The control panel 56 shown in FIG. 6 for example, desirably is provided with an on/off switch for the connector 51. As shown in FIG. 1 for example, each of the front lower right side panel 76*a* and rear lower right side panel 76*b* can be provided with a hinge at one edge thereof and a keyed lock 79 disposed toward the opposite edge thereof. Each of the hinged and lock-bearing side panels 76*a*, 76*b* desirably provides a door that selectively governs access respectively to the run/stop switch of the generator and the on/off switch for the connector 51. In this way, access is controlled by a respective generator door 76*a*, 76*b* that desirably can be locked in the closed position to prevent outside access respectively to the generator run/stop switch and the on/off switch for the connector 51. Moreover, the inside surface of each generator door 76*a*, 76*b* desirably also is insulated with sound deadening material to reduce the noise of the operating generator. The locked generator doors 76*a*, 76*b* serve to prevent tampering with the operation of the generator once the generator is running to generate electricity.

In another advantageous feature of an embodiment of the present invention, a single key desirably operates the all of the respective locking mechanisms 52*b*, 42*c*, 79 for the regulator compartment 52, the battery compartment 42 and the generator doors 76*a*, 76*b*.

While at least one presently preferred embodiment of the invention has been described using specific terms, such description is for illustrative purposes only, and it is to be understood that changes and variations may be made without departing from the spirit or scope of the invention.

The invention claimed is:

1. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a propane fuel tank connected in communication with said engine and carried by said frame above said engine, said propane fuel tank being selectively removable from said frame;

an electric generator carried by said frame and connected to said engine;

a first wheel assembly connected to said first side of said frame and rotatably carrying at least a first wheel; and a second wheel assembly connected to said second side of said frame and rotatably carrying at least a second wheel;

wherein said first wheel assembly including a first pivot pin extending transversely from said first wheel assembly and disposed to engage said frame and lift one end of said first wheel assembly with respect to the ground when one end of said frame is lifted a predetermined distance above the ground.

2. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a propane fuel tank connected in communication with said engine and carried by said frame above said engine, said propane fuel tank being selectively removable from said frame;

an electric generator carried by said frame and connected to said engine;

a first wheel assembly connected to said first side of said frame and rotatably carrying at least a first wheel, said first wheel assembly including a first inner wheel support plate defining an outer side and an inner side disposed opposite said outer side, said first wheel assembly including a front wheel axle extending from said outer side of said first inner wheel support plate, said first wheel assembly including a rear wheel axle extending from said outer side of said first inner wheel support plate and spaced apart from said front wheel axle, said first wheel assembly including a first wheel assembly journal extending from said inner side of said first inner wheel support plate and extending in a transverse direction parallel to said front wheel axle and said rear wheel axle, said first wheel assembly journal being pivotally connected to said first side of said frame; and a second wheel assembly connected to said second side of said frame and rotatably carrying at least a second wheel, said second wheel assembly including a second inner wheel support plate defining an outer side and an inner side disposed opposite said outer side, said second wheel assembly including a front wheel axle extending from said outer side of said second inner wheel support plate, said second wheel assembly including a rear wheel axle extending from said outer side of said second inner wheel support plate and spaced apart from said front wheel axle, said second wheel assembly including a second wheel assembly journal extending from said inner side of said second inner wheel support plate and extending parallel to said front wheel axle and said rear wheel axle, said second wheel assembly journal being pivotally connected to said second side of said frame.

3. An apparatus as in claim 2, wherein:

said first wheel assembly including a first pivot pin extending from said inner side of said first inner wheel support plate of said first wheel assembly and disposed closer to said rear wheel axle of said first wheel assembly than to said front wheel axle of said first wheel assembly; and said second wheel assembly including a second pivot pin extending from said second inner side of said inner wheel support plate of said second wheel assembly and disposed closer to said rear wheel axle of said second wheel assembly than to said front wheel axle of said second wheel assembly.

4. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame;

a propane fuel tank connected in communication with said engine and carried by said frame;

an electric generator carried by said frame and connected to said engine;

a first wheel assembly connected to said first side of said frame and rotatably carrying at least a first wheel, a second wheel assembly connected to said second side of said frame and rotatably carrying at least a second wheel; and said first wheel assembly including a first pivot pin extending transversely from said first wheel assembly and disposed to engage said frame and lift one end of said first wheel assembly with respect to the ground when one end of said frame is lifted a predetermined distance above the ground.

5. An apparatus as in claim 4, further comprising:

a mixing regulator valve carried by said frame and selectively connectable and disconnectable to said propane fuel tank.

6. An apparatus as in claim 5, further comprising:

a selectively accessible regulator compartment carried by said frame, said mixing regulator valve being disposed within said compartment.

7. An apparatus as in claim 4, wherein said propane fuel tank has a capacity of at least nine gallons and said propane fuel tank defines a central cylindrical axis of symmetry, said propane fuel tank being carried on said frame so that said central cylindrical axis of symmetry is disposed in a plane defined by said axial direction and said transverse direction of said frame.

8. An apparatus as in claim 4, further comprising:

at least one pair of securement straps, each securement strap having a pair of opposed ends, one end of each securement strap being anchored to said frame; and a selectively adjustable connector being selectively connected to the opposite ends of each said securement strap, said securement straps and said connector being configured to permit said propane fuel tank to be selectively removable from said frame.

9. An apparatus as in claim 4, further comprising: a retention rod carried by said frame and disposed to engage said propane fuel tank when said propane fuel tank is carried by said frame.

10. An apparatus as in claim 4, wherein:

said first wheel assembly including a first front wheel rotatably mounted to said first wheel assembly and a first rear wheel rotatably mounted to said first wheel assembly, said second wheel assembly including a second front wheel rotatably mounted to said second wheel assembly and a second rear wheel rotatably mounted to said second wheel assembly.

11. An apparatus as in claim 10, wherein:

said first front wheel of said first wheel assembly is spaced apart in said axial direction of said frame from said first rear wheel of said first wheel assembly.

12. An apparatus as in claim 4, further comprising:

a battery carried by said frame and electrically connected to said engine;

a trickle charger carried by said frame and electrically connected to said battery; and a battery compartment carried by said frame and defining an interior space and an opening providing access to said interior space, said battery compartment including a door connected to said battery compartment and selectively closing and exposing said opening, said battery compartment including a locking mechanism for selectively locking said door in a position closing said opening in said battery compartment, said battery and trickle charger being selectively disposed within said interior space of said battery compartment.

13. An apparatus as in claim 4, further comprising:

a front handle selectively retractably mounted to the front end of the frame; and a locking front panel connected to the front handle and configured to enable the user to selectively lock the front handle in a fully extended horizontal position.

14. An apparatus as in claim 13, further comprising:

a layer of sound insulating material disposed along an interior surface of said locking front panel in a manner that attenuates the noise of the generator when the front handle and locking front panel are retracted to their positions against the front of the frame.

15. An apparatus as in claim 4, further comprising:

a rear handle selectively retractably mounted to the rear end of the frame; and a locking mechanism configured for selectively locking said rear handle in the upright horizontal position so that when the user stops gripping the rear handle, the rear handle remains in the upright horizontal position, said locking mechanism including selectively alignable through holes defined through said rear handle and said frame, said locking mechanism including a pin selectively disposable through said alignable through holes.

16. An apparatus as in claim 4, further comprising:

at least one upper crossbrace extending transversely between said frame's first side and second side wherein said crossbrace defines an uppermost surface; and at least two spaced apart and resilient and skid resistant stacking disks connected to said uppermost surface of said crossbrace.

17. An apparatus as in claim 4, further comprising:

a first quick-disconnect member selectively connected to said first wheel assembly and configured to selectively permit quickly disconnecting said first wheel assembly from said first side of said frame.

18. An apparatus as in claim 4, further comprising:

a first wheel locking mechanism selectively disposable to prevent rotation of said first wheel, said first wheel locking mechanism including a U-shaped rod having two opposed free ends pivotally connected to said first wheel assembly.

19. An apparatus as in claim 4, further comprising:

an electrical output connector and an electric power cord carried by said frame, said power cord having one end connected to said electrical output connector and an opposite end connected to said generator; and a regulator compartment carried by said frame and defining a storage space and an opening providing access to said storage space, said regulator compartment including a door connected to said regulator compartment and selectively closing and exposing said opening, said regulator compartment including a locking mechanism for selectively locking said door in a position closing said opening in said regulator compartment, said electrical output connector and electric power cord being selectively disposed within said storage space of said regulator compartment, said regulator compartment further defining a front wall portion that is configured to permit the cover to be closed and locked while the connector is disposed outside the regulator compartment and connected to supply electric power to a load.

20. An apparatus as in claim 4, further comprising:

a hand guard panel attached to the end the frame nearer the internal combustion engine and defining a plurality of openings that facilitate air circulation but are not so large that an adult person could put one's hands through the openings.

21. A wheeled, manually movable, internal combustion engine powered electric generator, comprising:

a frame defining an axial direction and a transverse direction orthogonal to said axial direction, said frame further defining a front end and a rear end opposite said front end in said axial direction, the frame further defining a first side and a second side spaced apart in said transverse direction from said first side;

an internal combustion engine carried by said frame and including a rotatable output shaft;

an electric generator carried by said frame and including a stator and a rotor, said rotor being rotatably disposed with respect to said stator and connected to said engine's rotatable output shaft;

a propane fuel tank connected in communication with said engine and carried by said frame above said engine, said propane fuel tank being selectively removable from said frame, wherein said propane fuel tank has a capacity of at least nine gallons and said propane fuel tank defines a central cylindrical axis of symmetry, said propane fuel tank being carried on said frame so that said central cylindrical axis of symmetry is disposed in a plane defined by said axial direction and said transverse direction of said frame;

a retention rod carried by said frame and disposed to engage said propane fuel tank when said propane fuel tank is carried by said frame;

a propane fuel line carried by said frame and having one end connected to said engine;

a mixing regulator valve carried by said frame and selectively connectable and disconnectable to said propane fuel tank via said propane fuel line;

a selectively accessible compartment carried by said frame, said mixing regulator valve being disposed within said compartment;

at least one pair of securement straps, each said securement strap having a pair of opposed ends, one end of each said securement strap being anchored to said frame;

a selectively adjustable connector being selectively connected to the opposite ends of each said securement strap, said securement straps and said connector being configured to permit said propane fuel tank to be selectively removable from said frame;

at least one upper crossbrace extending transversely between said frame's first side and second side wherein said crossbrace defines an uppermost surface;

at least two spaced apart and resilient and skid resistant stacking disks that facilitate one generator to be stacked on top of another generator during shipping, said stacking disks being carried by said uppermost surface of said crossbrace;

a hand guard panel attached to the front end the frame near the internal combustion engine and defining a plurality of openings that facilitate air circulation but are not so large that a person could put one's hands through the openings;

a first wheel assembly and a second wheel assembly, said first wheel assembly being pivotally connected to said first side of said frame and said second wheel assembly being pivotally connected to said second side of said frame;

said first wheel assembly including a first front wheel rotatably mounted to said first wheel assembly and a first rear wheel rotatably mounted to said first wheel assembly, said second wheel assembly including a second front wheel rotatably mounted to said second wheel assembly and a second rear wheel rotatably mounted to said second wheel assembly;

said first wheel assembly including a first quick-disconnect member configured to selectively permit quickly disconnecting said first wheel assembly from said first side of said frame, said second wheel assembly including a second quick-disconnect member configured to selectively permit quickly disconnecting said second wheel assembly from said second side of said frame;

said first wheel assembly including an inner wheel support plate defining an outer side and an inner side disposed opposite said outer side, said first wheel assembly including a front wheel axle extending from said outer side of said inner wheel support plate, said first wheel assembly including a rear wheel axle extending from said outer side of said inner wheel support plate and spaced apart from said front wheel axle, said first wheel assembly including a first wheel assembly journal extending from said inner side of said inner wheel support plate and extending in a transverse direction parallel to said front wheel axle and said rear wheel axle;

said first wheel assembly including a first pivot pin extending from said inner side of said inner wheel support plate of said first wheel assembly and disposed closer to said rear wheel axle of said first wheel assembly than to said front wheel axle of said first wheel assembly;

said second wheel assembly including an inner wheel support plate defining an outer side and an inner side disposed opposite said outer side, said second wheel assembly including a front wheel axle extending from said outer side of said inner wheel support plate, said second wheel assembly including a rear wheel axle extending from said outer side of said inner wheel support plate and spaced apart from said front wheel axle, said second wheel assembly including a second wheel assembly journal extending from said inner side of said inner wheel support plate and disposed symmetrically with respect to said front wheel axle and said rear wheel axle;

said second wheel assembly including a second pivot pin extending from said inner side of said inner wheel support plate of said second wheel assembly and disposed closer to said rear wheel axle of said second wheel assembly than to said front wheel axle of said second wheel assembly;

a first wheel locking mechanism connected to said first wheel assembly and selectively disposable to prevent rotation of at least one of said first front wheel and said first rear wheel, said first wheel locking mechanism including a first U-shaped rod having two opposed free ends pivotally connected to said first wheel assembly and selectively disposable to prevent rotation of one of said first front wheel or said first rear wheel, said first U-shaped rod having a closed loop portion opposite the two free ends opposed to each other, said first U-shaped rod defining an intermediate section disposed between the opposed free ends and the closed loop portion, said intermediate section being bent at an angle relative to the plane in which the closed loop portion of the U-shaped rod resides;

a front handle selectively retractably mounted to the front end of the frame;

a locking front panel connected to the front handle and configured to enable the user to selectively lock the front handle in a fully extended horizontal position, a layer of sound insulating material disposed along an interior surface of said locking front panel in a manner that attenuates the noise of the generator when the front handle and locking front panel are retracted to their positions against the front of the frame;

a rear handle selectively retractably mounted to the rear end of the frame; and a locking mechanism configured for selectively locking said rear handle in the upright horizontal position so that when the user stops gripping the rear handle, the rear handle remains in the upright horizontal position;

a control panel carried by said frame and a control panel cover pivotally connected to said frame and selectively disposable over said control panel, which is provided with an on/off switch, said control panel cover having a keyed lock for securing said control panel cover over said control panel;

an electrical output connector and an electric power cord carried by said frame, said power cord having one end connected to said electrical output connector and an opposite end connected to said generator via said control panel;

a regulator compartment carried by said frame and defining a storage space and an opening providing access to said storage space, said regulator compartment including a door connected to said regulator compartment and selectively closing and exposing said opening, said electrical output connector and electric power cord being selectively disposed within said storage space of said regulator compartment, said regulator compartment further defining a front wall portion that is configured to permit the cover to be closed and locked while the connector is disposed outside the regulator compartment and connected to supply electric power to a load;

a battery carried by said frame and electrically connected to said engine, and a trickle charger carried by said frame and electrically connected to said battery;

a battery compartment carried by said frame and defining an interior space and an opening providing access to said interior space, said battery compartment including a door connected to said battery compartment and selectively closing and exposing said opening, said battery compartment including a locking mechanism for selectively locking said door in a position closing said opening in said battery compartment, said battery and trickle charger being selectively disposed within said interior space of said battery compartment.

* * * * *